US009820573B2

(12) United States Patent
Brunnmayr

(10) Patent No.: US 9,820,573 B2
(45) Date of Patent: Nov. 21, 2017

(54) SYNCHRONIZED LOCKING SYSTEM FOR A MOVABLE FURNITURE PART

(71) Applicant: Julius Blum GmbH, Hoechst (AT)

(72) Inventor: Harald Brunnmayr, Hoerbranz (AT)

(73) Assignee: JULIUS BLUM GMBH, Hoechst (AT)

( * ) Notice: Subject to any disclaimer, the term of this patent is extended or adjusted under 35 U.S.C. 154(b) by 319 days.

(21) Appl. No.: 14/242,072

(22) Filed: Apr. 1, 2014

(65) Prior Publication Data

US 2014/0210329 A1 Jul. 31, 2014

Related U.S. Application Data

(63) Continuation of application No. PCT/AT2012/000237, filed on Sep. 14, 2012.

(30) Foreign Application Priority Data

Oct. 24, 2011 (AT) ..... 1550/2011

(51) Int. Cl.
*A47B 95/00* (2006.01)
*A47B 88/16* (2006.01)
(Continued)

(52) U.S. Cl.
CPC ..... *A47B 88/16* (2013.01); *A47B 88/40* (2017.01); *A47B 88/46* (2017.01); *A47B 88/463* (2017.01);
(Continued)

(58) Field of Classification Search
CPC ..... A47B 88/16; A47B 88/04; A47B 88/07; A47B 88/0477; A47B 88/047;
(Continued)

(56) References Cited

U.S. PATENT DOCUMENTS 6,036,291 A 3/2000 Rock
7,467,833 B2 * 12/2008 Weng ..... E05B 65/463 312/221
(Continued)

FOREIGN PATENT DOCUMENTS

AT 511 329 11/2012
CN 1207279 2/1999
(Continued)

OTHER PUBLICATIONS

International Search Report (ISR) dated Nov. 19, 2012 in International (PCT) Application No. PCT/AT2012/000237.
(Continued)

*Primary Examiner* — Daniel J Troy
*Assistant Examiner* — Timothy M Ayres
(74) *Attorney, Agent, or Firm* — Wenderoth, Lind & Ponack, L.L.P.

(57) ABSTRACT

An arrangement includes two locking devices which are arranged on either side of a movable furniture part for locking the movable furniture part with respect to a furniture body in a locking position. Each locking device has a blocking device which prevents the locking position from being reached in a blocking position. Each locking device has a releasing device by means of which the blocking position of the blocking device associated with the other locking device can be cancelled.

17 Claims, 33 Drawing Sheets

(51) Int. Cl.

| | |
|---|---|
| ***A47B 88/46*** | (2017.01) |
| ***A47B 88/467*** | (2017.01) |
| ***E05B 65/46*** | (2017.01) |
| ***A47B 88/40*** | (2017.01) |
| ***A47B 88/463*** | (2017.01) |
| ***A47B 88/57*** | (2017.01) |
| *A47B 88/47* | (2017.01) |

(52) U.S. Cl.
CPC ..... *A47B 88/467* (2017.01); *A47B 88/57* (2017.01); *E05B 65/46* (2013.01); *A47B 88/47* (2017.01); *A47B 2210/0083* (2013.01)

(58) Field of Classification Search
CPC ..... A47B 88/048; A47B 2210/0083; A47B 88/46; A47B 88/463; A47B 88/467; E05B 65/46
USPC ..... 312/333
See application file for complete search history.

(56) References Cited

U.S. PATENT DOCUMENTS

| | | | | |
|---|---|---|---|---|
| 8,474,925 | B2 | 7/2013 | Koenig et al. | |
| 8,764,135 | B1 * | 7/2014 | Huang | A47B 88/04 312/331 |
| 2003/0117048 | A1 | 6/2003 | Mueller | |
| 2007/0103041 | A1 | 5/2007 | Kropf et al. | |
| 2007/0103043 | A1 | 5/2007 | Kropf et al. | |
| 2010/0314981 | A1 | 12/2010 | Koenig et al. | |
| 2010/0320888 | A1 | 12/2010 | Koenig et al. | |
| 2010/0327719 | A1 | 12/2010 | Koenig et al. | |
| 2013/0129266 | A1 * | 5/2013 | Chen | A47B 88/04 384/20 |
| 2013/0334946 | A1 | 12/2013 | Netzer et al. | |
| 2014/0021841 | A1 | 1/2014 | Brunnmayr | |

FOREIGN PATENT DOCUMENTS

| | | |
|---|---|---|
| CN | 2650617 | 10/2004 |
| CN | 101977534 | 2/2011 |
| DE | 101 25 324 | 3/2002 |
| DE | 101 62 573 | 7/2003 |
| DE | 20 2009 013 733 | 3/2011 |
| EP | 0 101 619 | 2/1984 |
| EP | 1 183 963 | 3/2002 |
| EP | 1 314 842 | 5/2003 |
| EP | 1 785 062 | 5/2007 |
| EP | 2 322 745 | 5/2011 |
| JP | 2011-514217 | 5/2011 |
| JP | 2011-515129 | 5/2011 |
| WO | 2009/114884 | 9/2009 |
| WO | 2009/114887 | 9/2009 |
| WO | 2010/129971 | 11/2010 |

OTHER PUBLICATIONS

Austrian Patent Office Search Report (ASR) dated May 30, 2012 in Austrian Patent Application No. A 1550/2011.

* cited by examiner

SYNCHRONIZED LOCKING SYSTEM FOR A MOVABLE FURNITURE PART

BACKGROUND OF THE INVENTION

The invention concerns an arrangement having two locking devices arranged on both sides of a moveable furniture part for locking the moveable furniture part in a locking position with respect to a furniture carcass. The invention further concerns an article of furniture having such an arrangement.

Locking devices for furniture parts have already been known for many years in order to hold the moveable furniture parts (drawers) in a closed position in the furniture carcass. Such locking devices are appropriate in particular when active ejection devices for the moveable furniture part are integrated in the article of furniture. By virtue of unlocking of the locking device, that ejection device then becomes active and moves the furniture part from a closed position into an open position from which it can then generally be further opened by hand. In the case of relatively small drawers (about 50 cm in width) and in the case of light drawers, a single one of such ejection devices and locking devices is generally sufficient. In order, however, to guarantee easily moveable and straight ejection of the drawer, in particular when wide drawers are involved, those lockable ejection devices are mostly arranged on both sides of the drawer, on the drawer or on the furniture carcass, respectively. In most cases, those lockable ejection devices also have a so-called touch-latch mechanism which makes it possible to unlock the locking device by pressing on the drawer when in the closed position, thereby to cause drawer ejection. To prevent one-sided and skewed ejection with such ejection devices on both sides—in that case the drawer could become jammed in the furniture carcass—various synchronization mechanisms are already known.

For that purpose for example WO 2010/129971 A1 discloses a double-sided ejection device in which the linearly displaceable sliders of the two unlockable ejection devices are motionally coupled by way of a rotatable synchronization bar.

WO 2009/114884 A2 also discloses a synchronization unit for locking units of a lockable ejection device.

In addition EP 1 314 842 B1 discloses a device for opening and closing a moveable furniture part, which permits synchronous ejection of two ejection devices associated with one drawer.

In addition, the Austrian application bearing the application number A 614/2011 which is to the present applicant and which is not a prior publication discloses a lockable ejection device having a synchronization mechanism for lockable sliders of the ejection device. In that case, connecting elements at both ends of a synchronization bar have teeth engaging into synchronization teeth on the slider.

A disadvantage with all synchronization mechanisms known from the state of the art is that those synchronization mechanisms are only concerned with synchronization of the ejection movement and do not guarantee synchronous locking or even prevent that. That leads to problems in particular when the drawer is pushed in inclinedly or in a skewed position so that locking takes place firstly on one side. As soon as that locking has occurred on one side no locking can occur on the other side and the ejection device cannot be adequately stressed so that once again the drawer is ejected only at one side. It can, however, also happen that a user of the drawer notices that the drawer is closed only at one side and tries to move the side of the drawer which is not closed and which is skewed into the closed position by hand, in which case that can even lead to damage in the locking devices. If for example in accordance with A 614/2011 one side of the ejection device is already in the closed position while the other lags behind it is no longer possible for any further movement to take place by means of the teeth of the synchronization bar, and in addition the teeth of the connecting element, due to the effect of a high level of force, come out of engagement with the toothed bar, which can cause damage.

SUMMARY OF THE INVENTION

Therefore, the object of the present invention is to provide an arrangement which is improved over the state of the art, having two locking devices. In particular the invention seeks to permit reliable and trouble-free closing on both sides of a moveable furniture part.

That object is achieved in that each locking device has a blocking device which, in a blocking position, prevents attainment of the locking position. Each locking device has a release means by which the blocking position of the blocking device respectively associated with the other locking device can be cancelled. In general terms, this means that a locking action can take place on one side of the moveable furniture part only when the other side of the moveable furniture part has already been moved sufficiently far into the furniture carcass. That, therefore, allows locking only when the drawer is pushed in straight and parallel or when the drawer is only in a really slightly inclined position. Once again, in other words, this means that the release means on one side detects how far the drawer at that side is still away from the closed position and cancels the blocking action on the other side and permits locking there, when a given small spacing is reached (for example between 0 and 5 mm).

In specific terms this can be effected by position sensors which, by way of electric signals, nullify the blocking position of the corresponding blocking device on the other side and thus permit locking. A variant of the present invention can provide for that purpose that only the respective blocking position of the blocking device respectively associated with the other locking device can be cancelled by each release means. That can preferably be effected by a control or regulating device.

As an alternative thereto and preferably, the release means are connected together by way of a synchronization bar, wherein the blocking position of both blocking devices can be cancelled at the same time. Therefore, the blocking action is released on both sides by that synchronization bar, that preferably being effected by the blocking device in the blocking position preventing rotation of the synchronization bar.

In a specific mechanical embodiment of the present invention, each of the two locking devices has a slider displaceable with respect to a housing between a locking position and an open position, and each of the two sliders has a guide path in which a respective connecting element is displaceable to an end abutment and—in dependence on radially projecting extensions on the connecting element, that bear against the guide path—is rotatably guided and the connecting elements are coupled in motional coupling relationship by way of the synchronization bar. An end abutment of at least one of the guide paths, a narrow portion of at least one guide path, and an extension of at least one connecting element form the blocking device and a wide portion of both guide paths, and both connecting elements and the synchronization bar form the release means. In the blocking position, at least one extension of a connecting element bears against the narrow portion of the guide path and prevents a rotary movement of the connecting element and the synchronization bar. In the cancelled blocking position, extensions of both connecting elements are arranged in the wide portion of the respective guide path and thereby both connecting elements are rotatable together with the synchronization bar. In particular, by virtue of the fact that the synchronization bar does not have to constantly rotate (as for example in A 614/2011) but moves in the guide path or slidingly moves therein, trouble-free movement can be made possible after cancellation of the blocking position, even when a skewed position is involved.

Locking in the blocking position is prevented in particular in that in the blocking position, at least the extension of a connecting element limits the displacement travel of the slider by bearing against the end abutment and thereby prevents locking of the slider in the locking position. In the cancelled blocking position, the extension is moveable away from the end abutment, preferably being rotatable away therefrom, whereby the displacement travel of the slider is free and the slider is lockable in the locking position.

In order to enforce simultaneous locking on both sides, it is preferably provided that in the cancelled blocking position, extensions of both connecting elements are moveable away from the respective end abutments, preferably being rotatable away therefrom, whereby the displacement travels of both sliders are free and both sliders are lockable synchronously in the locking position. This is achieved in particular when the wide portion of the guide path is of a length (about between 2 and 5 mm) which is scarcely longer than the extension projecting from the connecting element.

In that respect, however, another variant of the invention can provide that locking of a second locking device is made possible even when the first locking device is already locked and the drawer still involves a certain inclined position. That is achieved in that, in the cancelled blocking position and with a slider locked in the locking position, the slider associated with the other locking device is moveable into the locking position. In particular, that is made possible by the wide portion of the guide path being provided not just in the very last part of the closing movement, but is several millimeters in length (for example between 5 and 25 mm).

As is known per se, in accordance with a further embodiment, each locking device respectively can include a slider, a control lever, a sliding guide path and a control pin. The slider is lockable in the locking position in the sliding guide path provided in the housing by way of the control pin arranged on the control lever.

BRIEF DESCRIPTION OF THE DRAWINGS

Further details and advantages of the present invention will be described more fully hereinafter by means of the specific description with reference to the embodiments illustrated in the drawings in which.

DETAILED DESCRIPTION OF THE DRAWINGS

In principle, it should be noted that FIGS. 1 through 13 are identical to the Figures in above-mentioned Austrian application No A 614/2011. This means that all functions shown therein are in principle also provided in the invention here. Only the configuration of the connecting element 23, the synchronization teeth 26 and the guidance for the connecting element 23 in the slider 11 differ from the structure which is already known.

Figure 1:
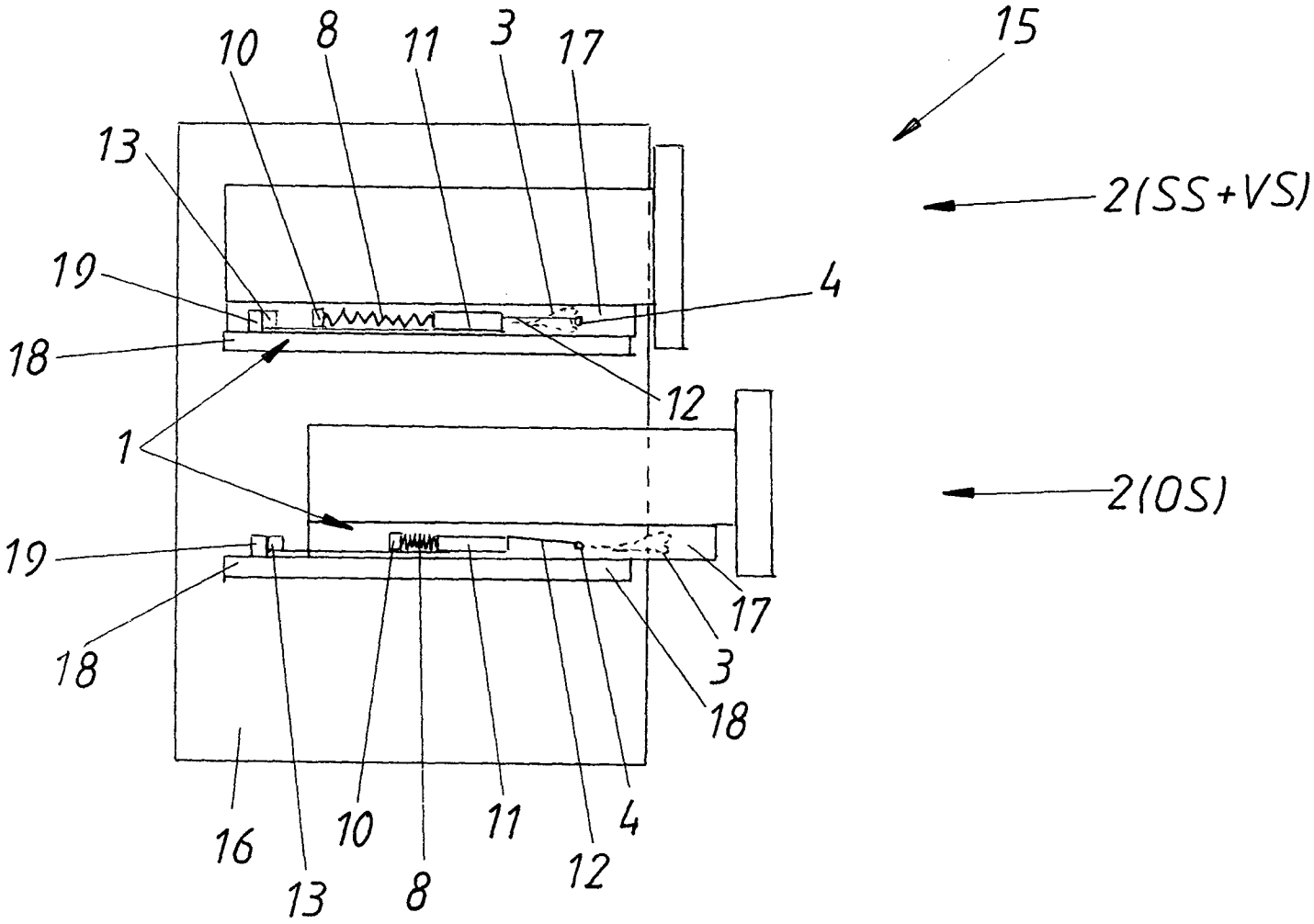
FIG. 1 diagrammatically shows an article of furniture with closed and opened drawer.

Accordingly, FIG. 1 shows an article of furniture 15 including a furniture carcass 16 and two moveable furniture parts 2. In this case, the upper moveable furniture part 2 is disposed in the closed position SS, the control pin 4 being held in the locking position VS in the sliding guide path 3. The control pin 4 is connected by way of a control lever 12 to a slider 11 displaceable in the housing 10 (only diagrammatically indicated here). The slider 11 is connected to the housing 10 by way of an ejection spring 8, the ejection spring 8 (tension spring) being stressed in that locking position. That ejection device 1 is mounted to the drawer rail 17, the drawer rail 17 being locked, that is to say not displaceable, relative to the carcass rail 18, as the drawer rail 17 is held by way of the ejection device 1 and its diagrammatically illustrated ejection element 13 (with locking hooks) to the entrainment member 19 (also shown diagrammatically) of the carcass rail 18.

If now—as shown in the case of the lower moveable furniture part 2 in FIG. 1—triggering is effected (both by over-pressing and also by pulling on the moveable furniture part 2), then the control pin 4 passes outside the locking portion of the sliding guide path 3. As then the slider 11 is no longer locked in the sliding guide path 3 the ejection spring 8 can contract, whereby the housing 10 of the ejection device 1 together with the moveable furniture part 2 mounted thereon is moved in the opening direction OR. As the slider 11 itself is still connected in positively locking relationship to the entrainment member 19 by way of the ejection element 13, displacement of the housing 10 occurs with respect to the slider 11 and the moveable furniture part 2 passes into the open position OS.

Figure 2:
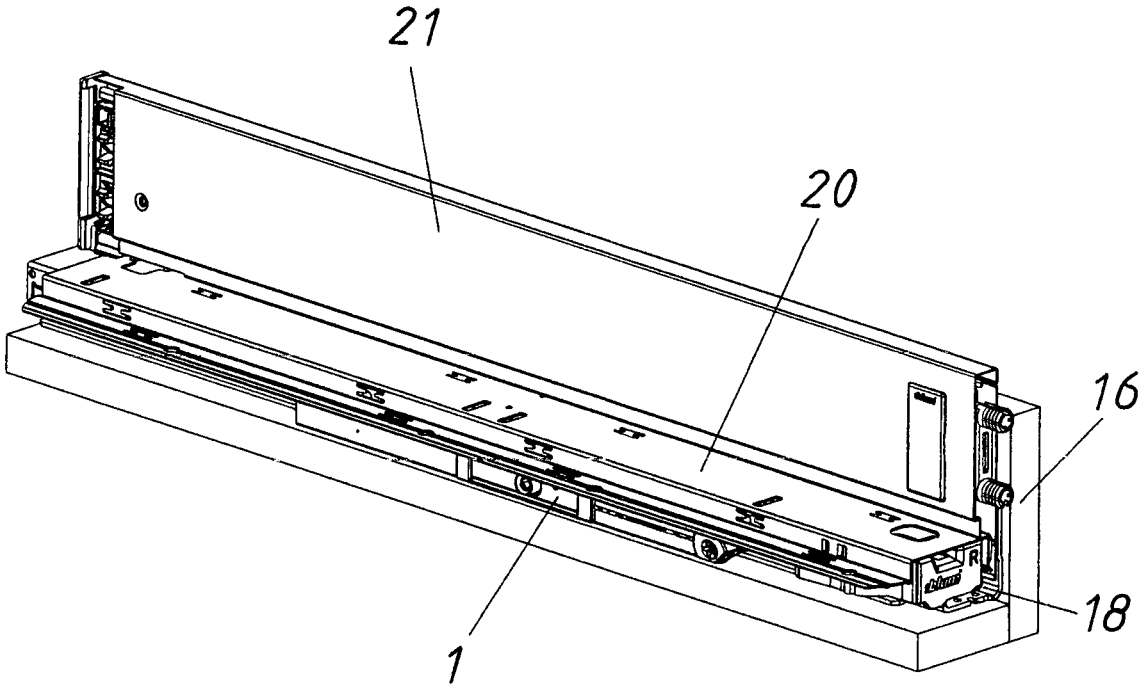
FIG. 2 is a view of a drawer extension guide with drawer side wall and furniture carcass.

FIG. 2 shows a side wall of the moveable furniture part 2 and the container rail 20 which is held to the drawer rail 17 (barely visible here). The ejection device 1 is fixed under that drawer rail 17 or under the container rail 20.

Figure 3:
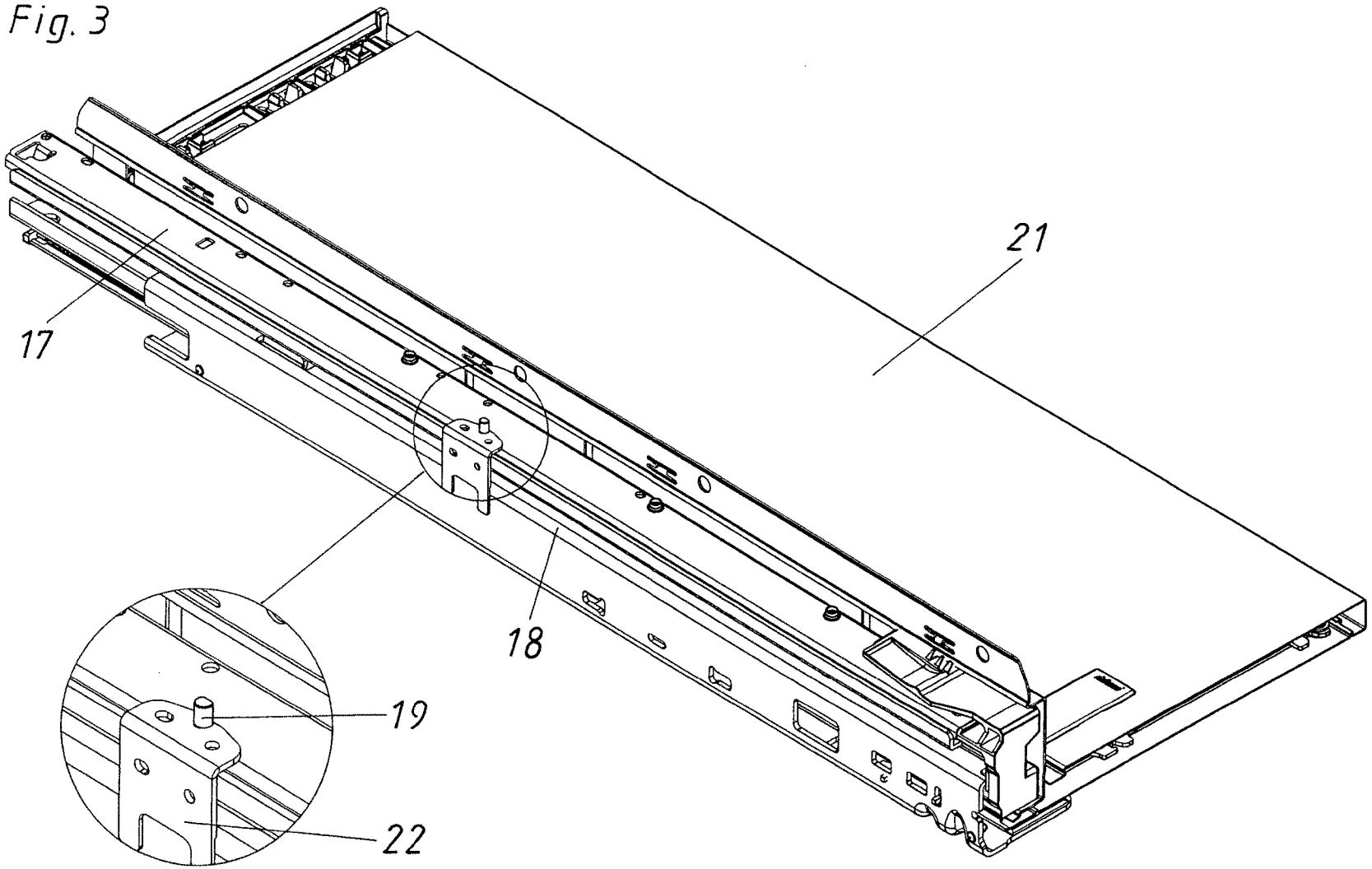
FIG. 3 shows a part of the drawer side wall with extension guide.

The drawer side wall 21 is shown in FIG. 3. The entrainment member 19 is fixed to the carcass rail 18 by way of a mounting element 22.

Figure 4:
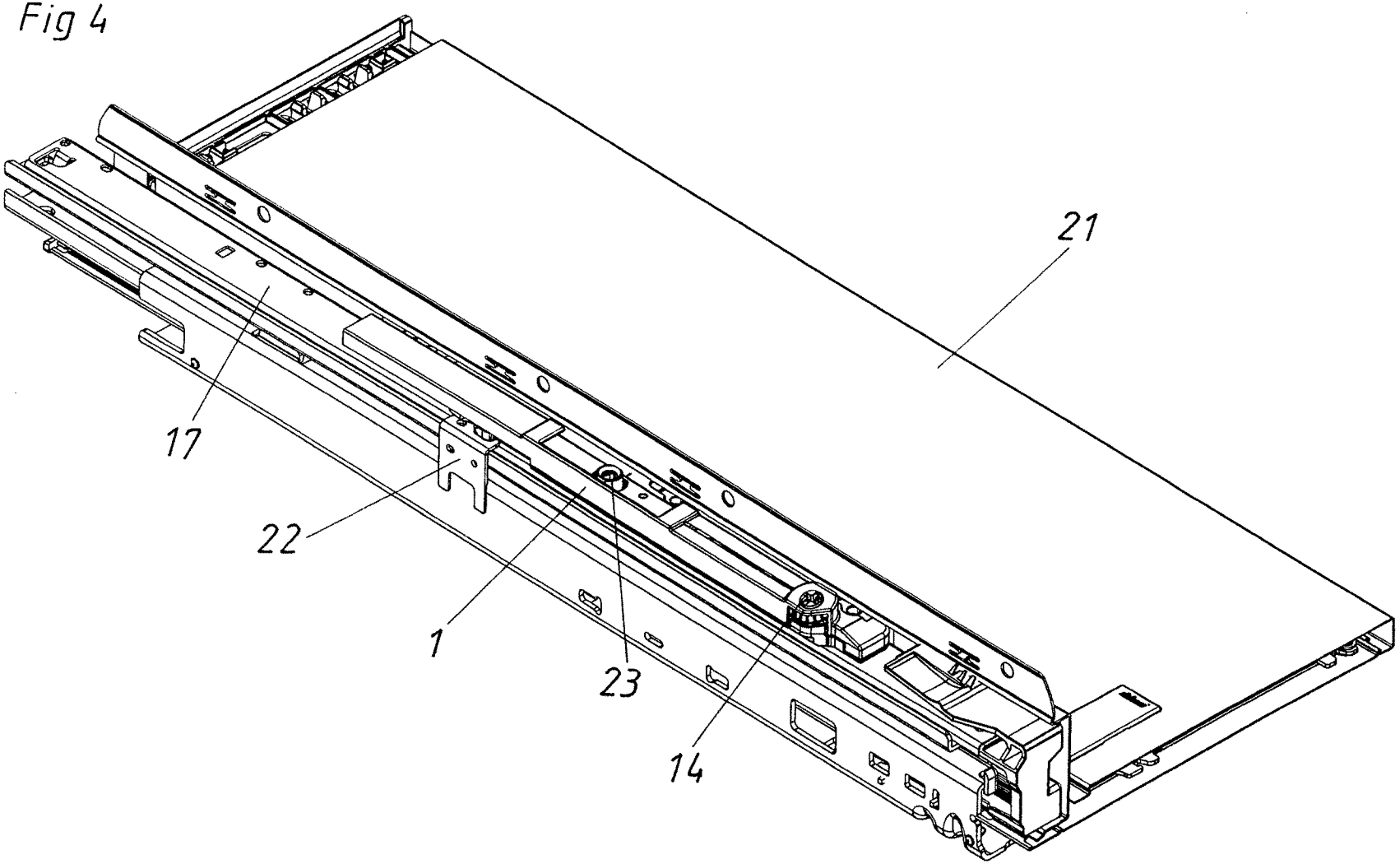
FIG. 4 shows FIG. 3 with fitted ejection device.

FIG. 4 shows the drawer side wall 21 together with the ejection device 1 mounted to the drawer rail 17. The connecting element 23 for synchronization with a second ejection device associated with another drawer side wall (not shown) and a depth adjusting device 14 can be seen here.

Figure 5:
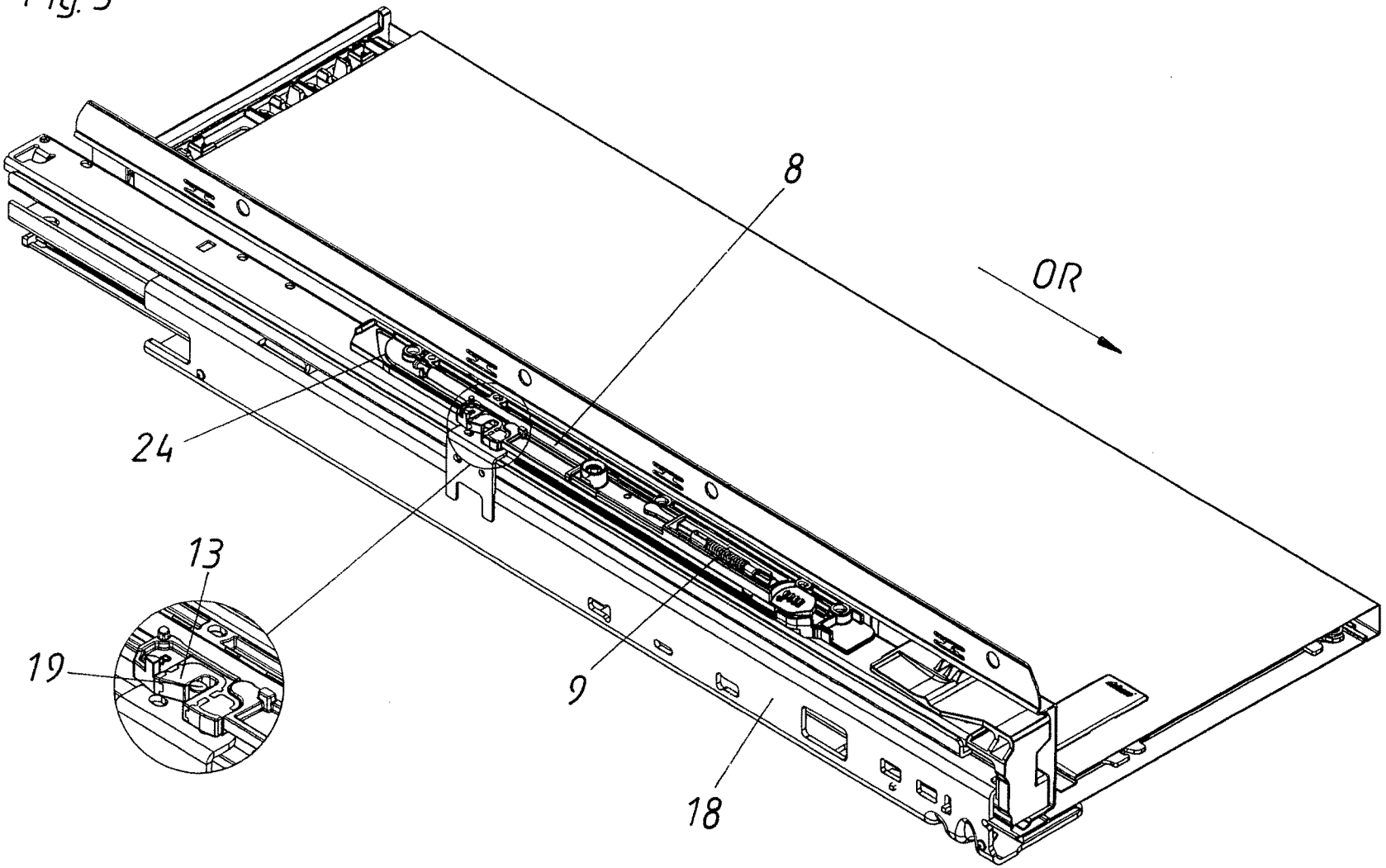
FIGS. 5 through 7 show different positions of the moveable furniture part relative to the carcass rail.

In FIG. 5, the housing cover 10*c* has been removed from the ejection device 1, thereby giving a view into the ejection device 1. It will be seen therein that the ejection element 13 (locking hook) is connected to the entrainment member 19 in a positively locking relationship. That ejection element 13 moves in the guide path 24. The ejection spring 8 and the spring 9 (locking spring) for the locking element 7 are also shown.

Figure 6:
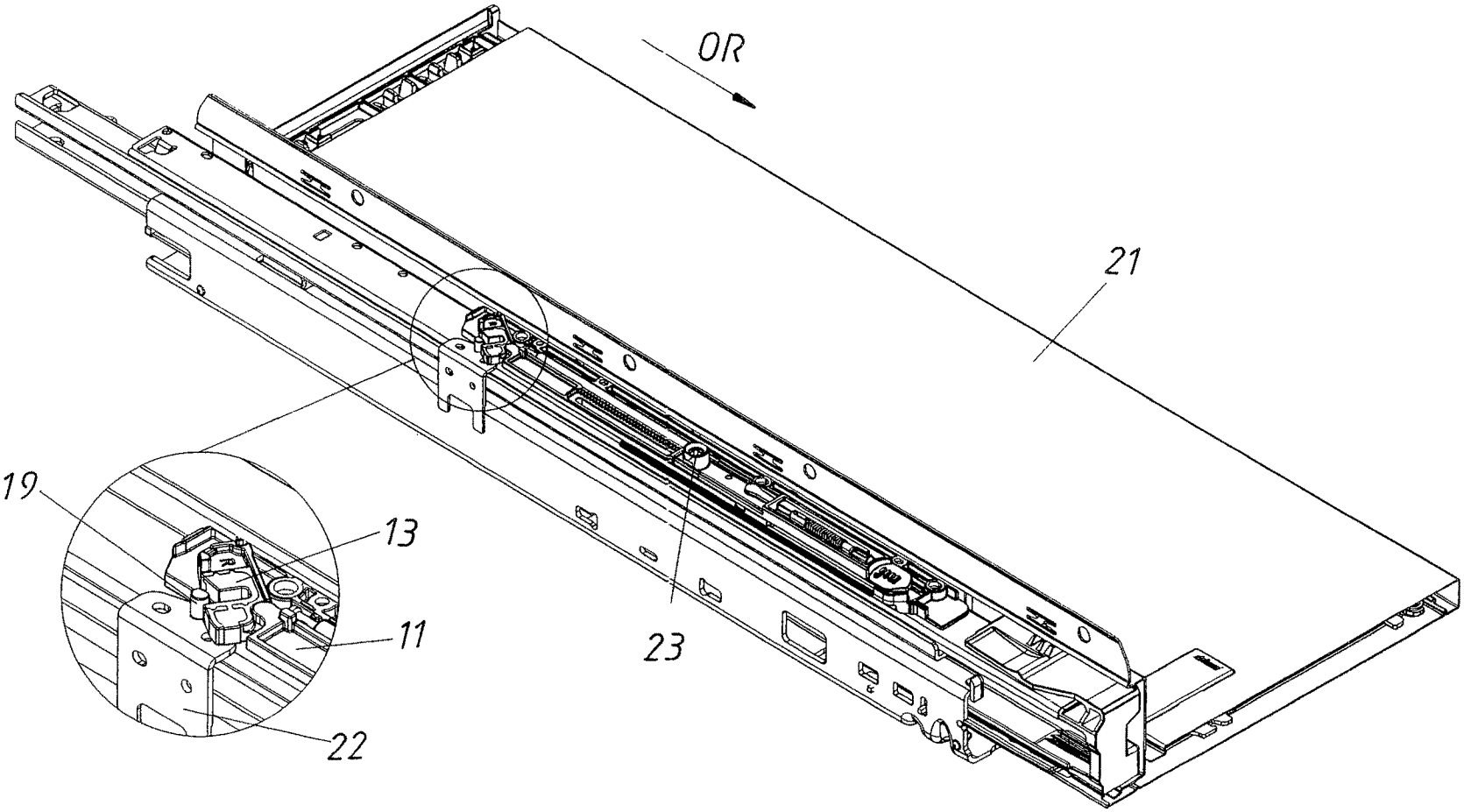
Figure 7:
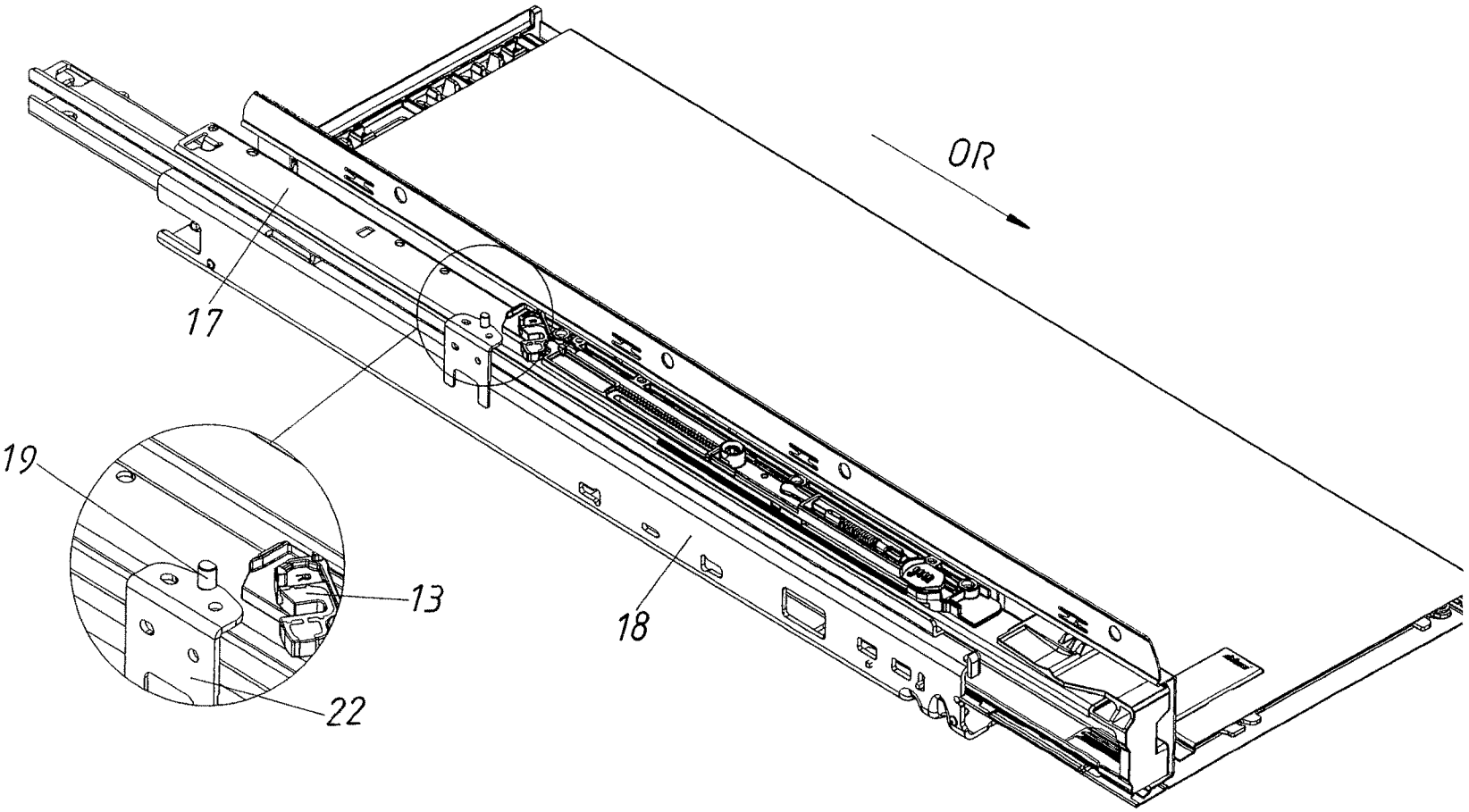

In FIG. 6 the moveable furniture part 2 with drawer side wall 21 has been moved further in the opening direction OR, wherein the ejection element 13 has moved into the inclined end region of the guide path 24 and is thereby pivoted with respect to the slider 11 and releases the entrainment member 19. From that moment or from that position, the moveable furniture part 2 can be moved freely in the opening direction OR (see also FIG. 7).

Figure 8:
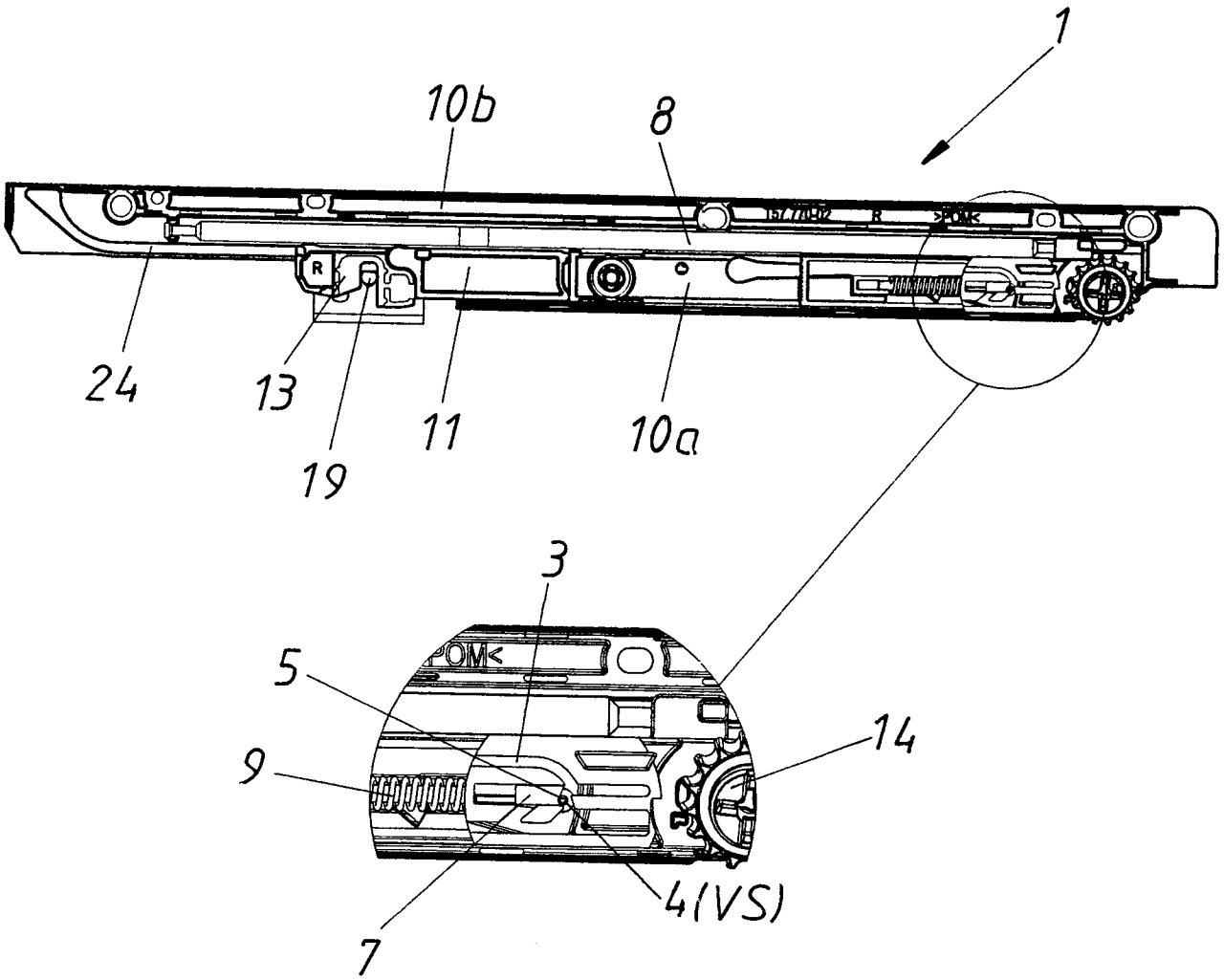
FIGS. 8 through 12 show a side view of the ejection device in different positions.

FIG. 8 shows a view of the ejection device 1 from the center of the furniture part. In this case, the housing cover 10*c* has been entirely removed. In addition, a part of the displaceable part 10*a* is also cut away, thereby giving a view on to the sliding guide path 3 in the displaceable part 10*a*. In FIG. 8, the control pin 4 is in the locking position VS and bears in the latching recess 5 against the locking element 7.

Figure 9:
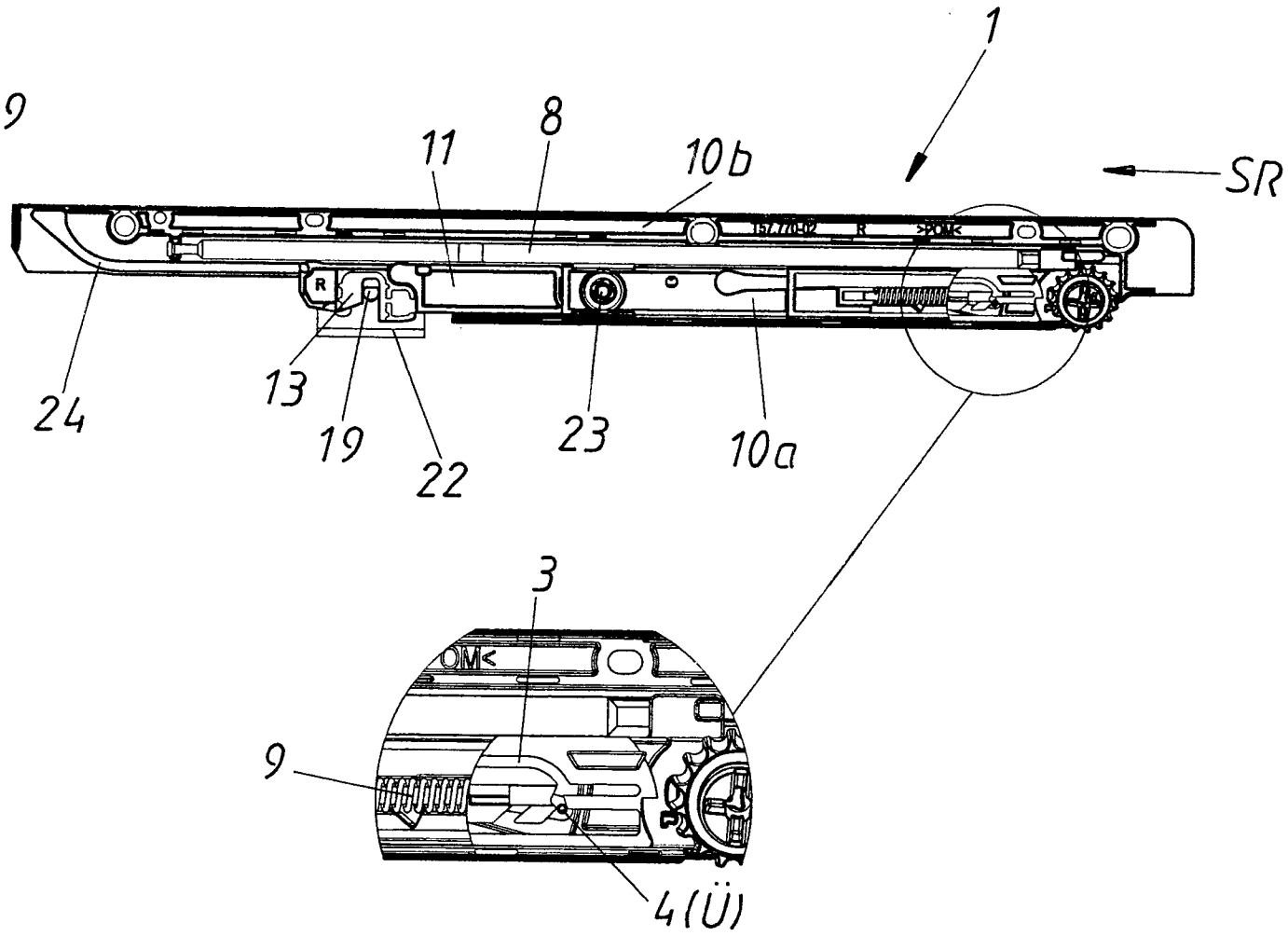
Figure 18:
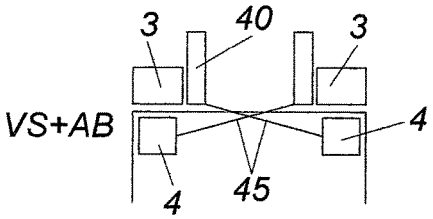

FIG. 9 shows the control pin 4 in the over-pressed position U and goes from the locking portion 3*b* into the opening portion 3*c* (see also FIG. 18).

Figure 10:
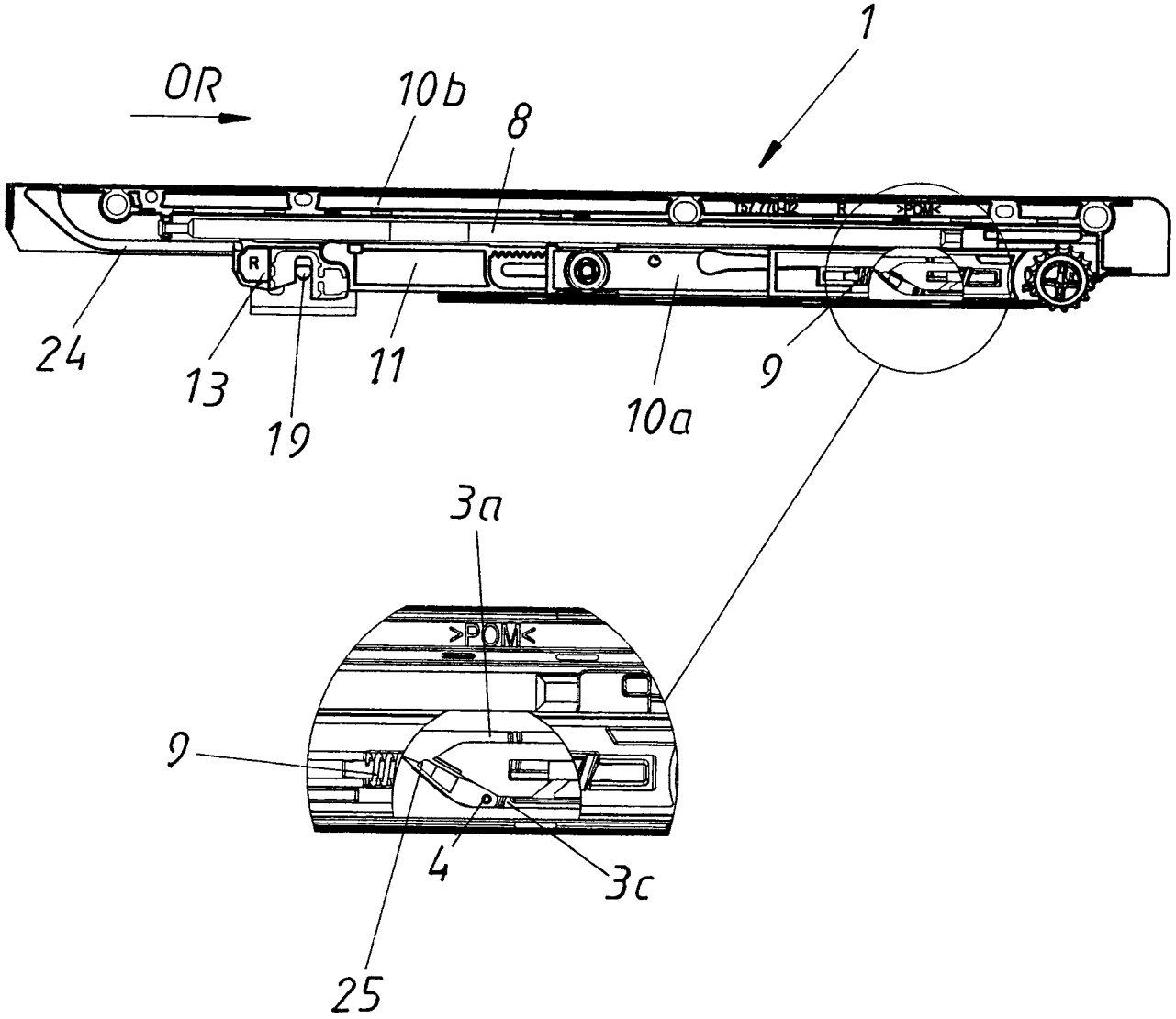

In FIG. 10, the action of the ejection spring 8 has already started, whereby the mounting part 10*b* of the housing 10 is moved in the opening direction OR with respect to the slider 11 as the slider 11 itself is held by the ejection element 13 (with locking hook) to the entrainment member 19 and thus to the furniture carcass 16. The control pin 4 is shown shortly before passing over the branching element 25, the control pin 4 urging that spring-loaded branching element 25 downwardly, which after the passing movement goes back into the starting position again. When the control pin 4 subsequently moves in the closing direction SR, that means that the control pin 4 does not pass into the opening portion 3*c* but into the closing portion 3*a* or is deflected in that way.

Figure 11:
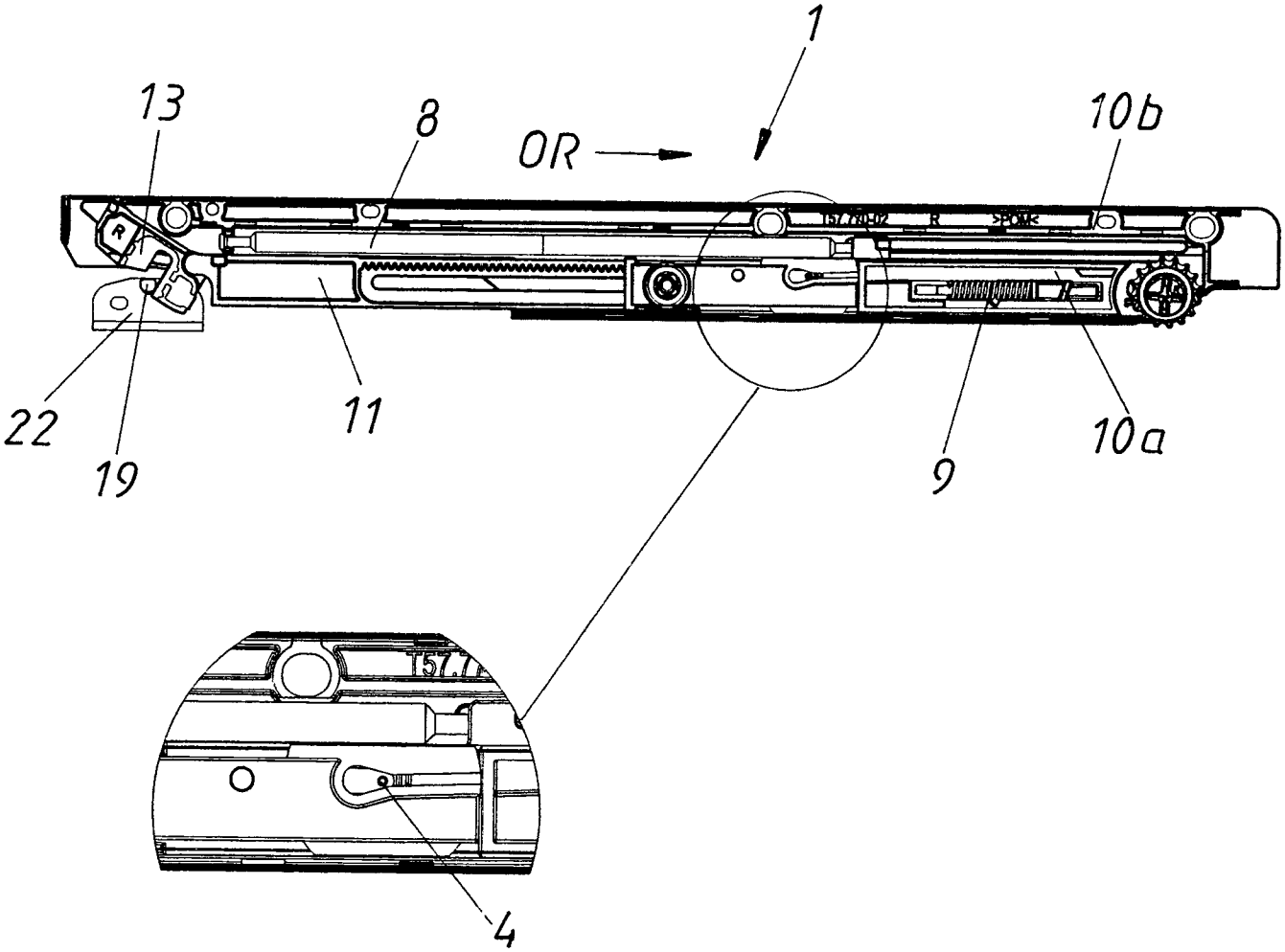

In FIG. 11, the ejection spring 8 has been completely unloaded (that is to say contracted) and the slider 11 has moved the ejection element 13 into the inclined end portion of the guide path 24 so that the ejection element 13 pivots and the positively locking connection between the ejection element 13 and the entrainment member 19 is released.

Figure 12:
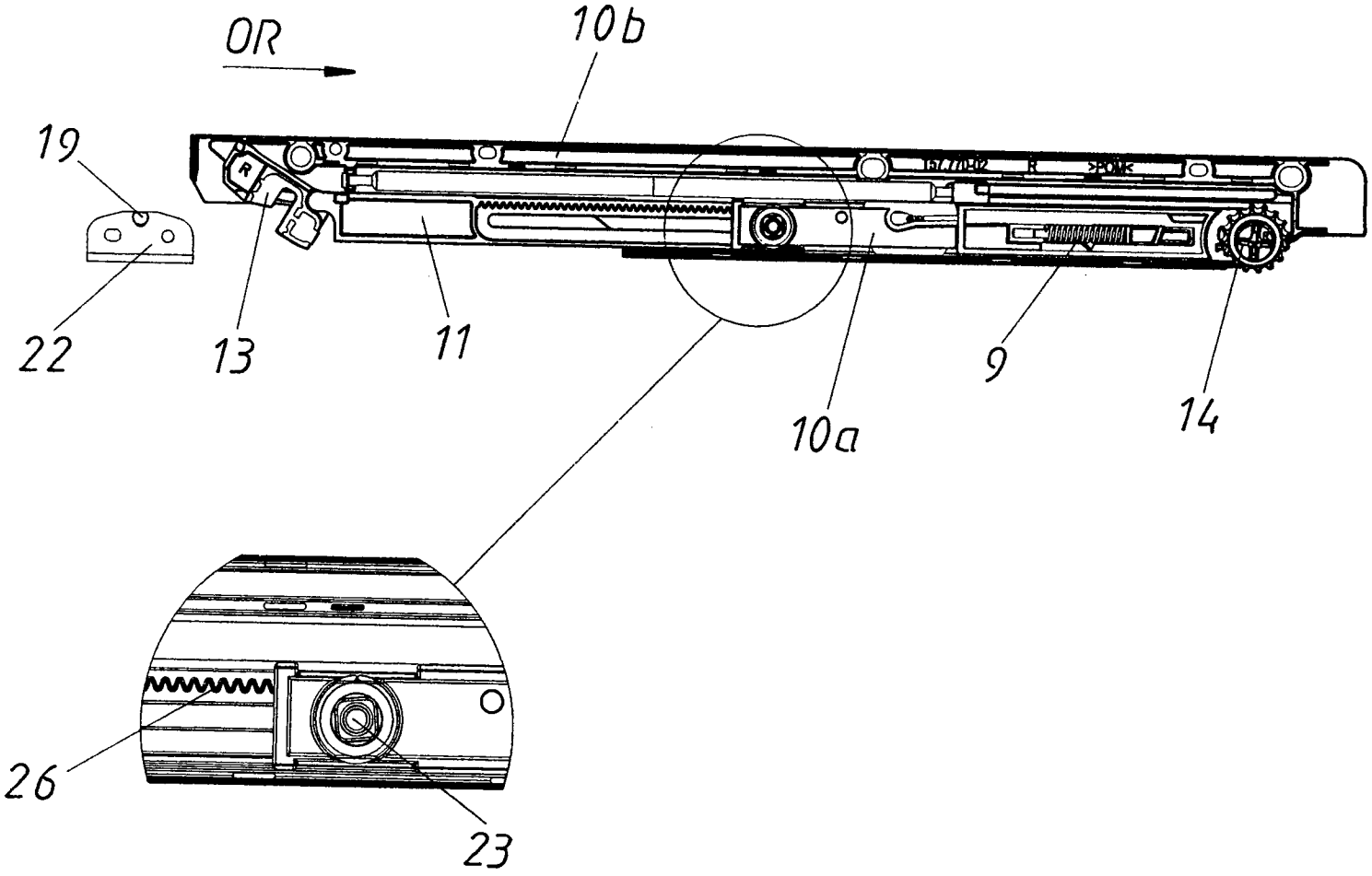

In FIG. 12 the ejection device 1 is no longer held to the entrainment member 19 so that the entire moveable furniture part 2 is freely moveable.

Figure 13:
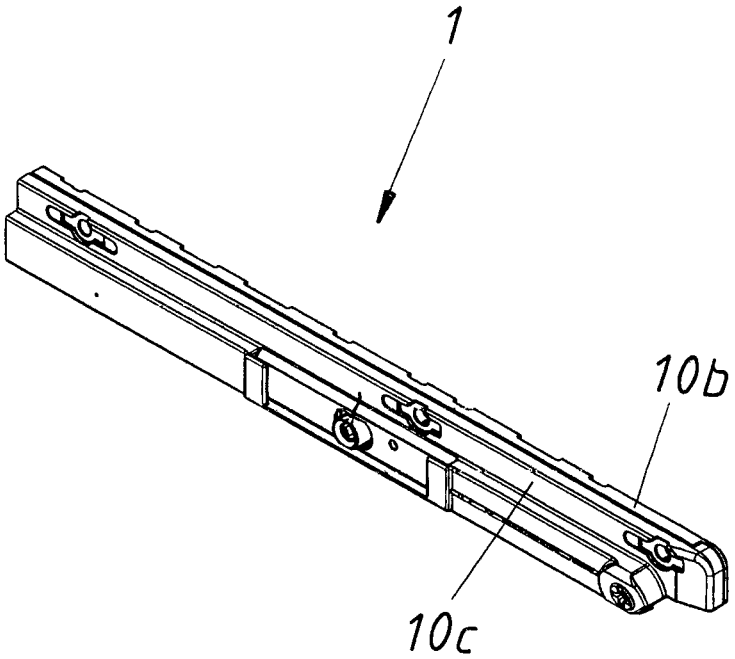
FIG. 13 shows the ejection device in the form of a structural unit.

FIG. 13 shows the narrow elongate ejection device 1 is the assembled condition.

Figure 14:
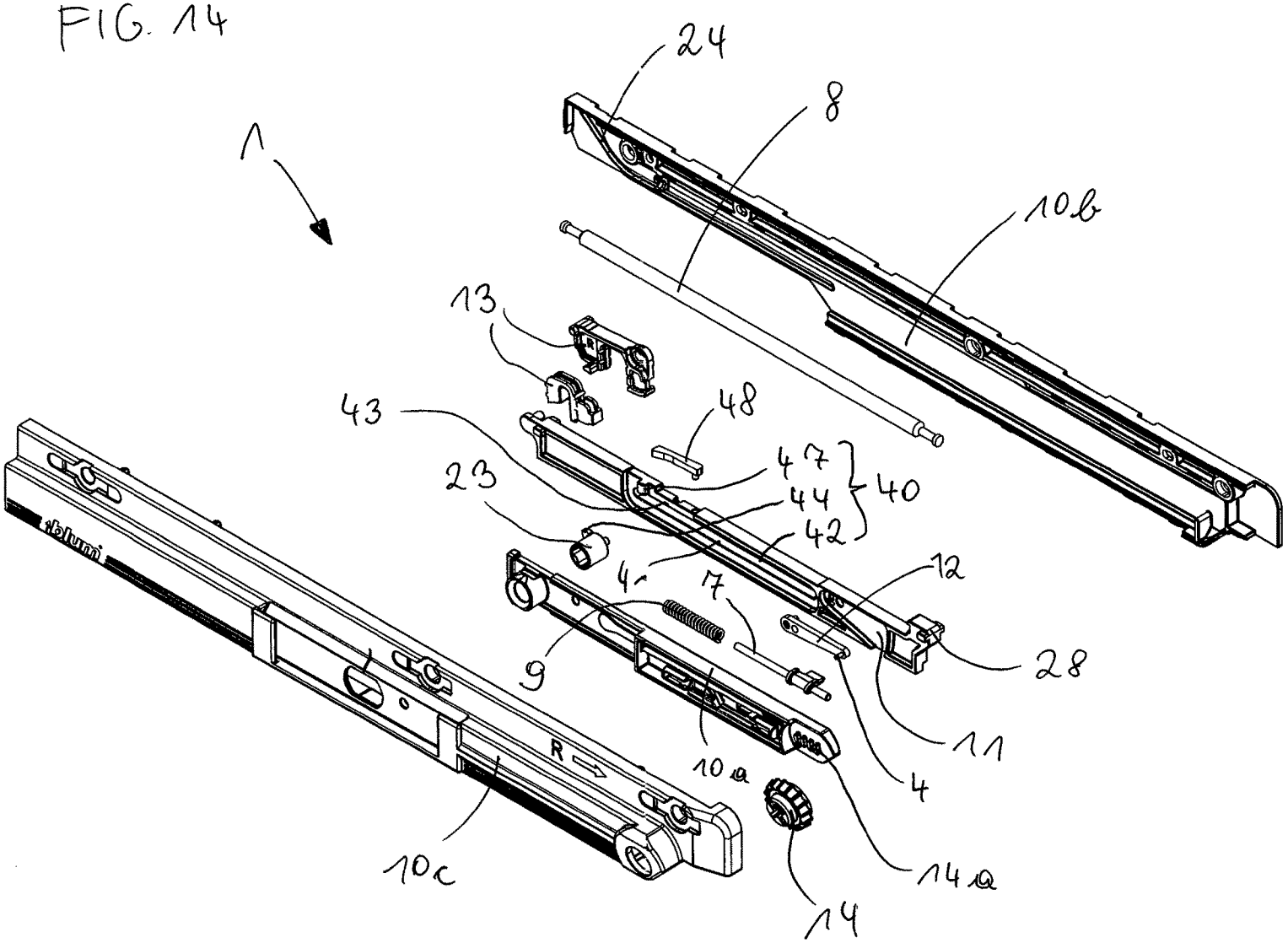
FIGS. 14 and 15 are exploded views of the ejection device from two different sides.
Figure 15:
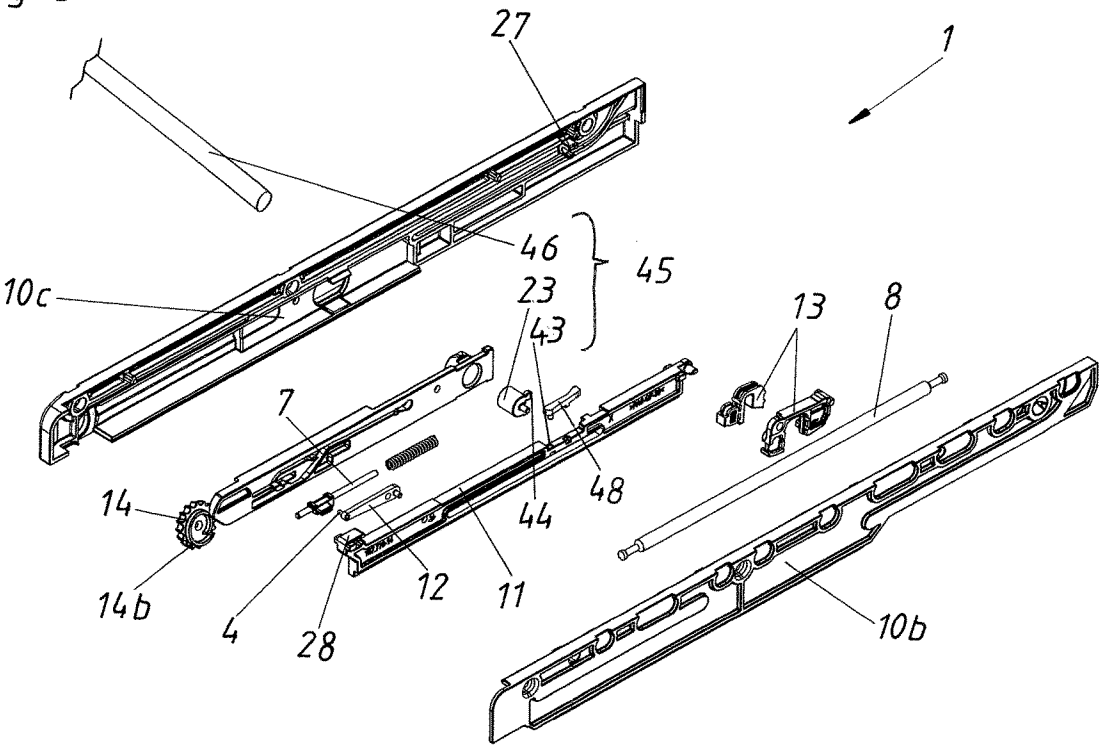

FIGS. 14 and 15 show an exploded view of the ejection device 1 from different sides. As large components, that ejection device 1 has a housing 10 comprising the mounting part 10*b*, the housing cover 10*c*, and the displaceable part 10*a*. The ejection device 1 is connected to the moveable furniture part 2 or to the drawer rail 17 by way of the mounting part 10*b*. The housing cover 10*c* is fixedly connected to the mounting part 10*b* by way of conventional connecting means. The displaceable part 10*a* is arranged between those two parts, wherein displacement and thus the depth of the locking position of the entire drawer 2 can be adjusted by way of the depth adjusting device 14. At its underside, that rotatable depth adjusting device 14 has a spiral worm 14*b* corresponding to latching means 14*a* provided on the displaceable part 10*a*. The sliding guide path 3 is provided in the displaceable part 10*a*, wherein the latching recess 5 of the sliding guide path 3 is formed by the locking element 7. That locking element 7 is mounted displaceably and is acted upon by the force of the spring 9 (compression locking spring). The slider 11 is mounted slideably or displaceably with respect to the entire housing 10. The control lever 12 is pivotably mounted to that slider 11 and at one end has the control pin 4 which engages into the sliding guide path 3. In addition, the ejection element 13 is mounted pivotably at one end of the slider 11. The slider 11 has a guide path 41 for a connecting element 23 on which a synchronization bar 46 can provide connection to a further ejection device provided in substantially mirror-symmetrical relationship at the other side of the drawer. In addition, the ejection device 1 has an ejection spring 8 held between the spring holder 27 on the housing cover 10*c* and the spring holder 28 on the slider 11.

It will also be seen from FIGS. 14 and 15 that the guide path 41 has a narrow portion 42—with respect to a direction transverse relative to the longitudinal extent of the slider 11—and a wide portion 43. In addition, those two Figures show the essential components of the locking device, namely the blocking device 40 and the release device 45. In this arrangement, the blocking device 40 includes the extensions 44 on the connecting element 23, the narrow portion 42 of the guide path 41, and the end abutment 47 of the guide path 41. In comparison, the synchronization bar 46, the connecting elements 23 on both sides of the synchronization bar 46, and the wide portions 43 of the guide paths 41 of both locking devices form the release device 45.

In general these exploded views in FIGS. 14 and 15 show the embodiment which is the same as that of FIGS. 29 through 33, wherein a holding element 48 in the form of a rocker lever is mounted on the slider 11 in the wide portion 43 of the guide path 41.

Figure 16:
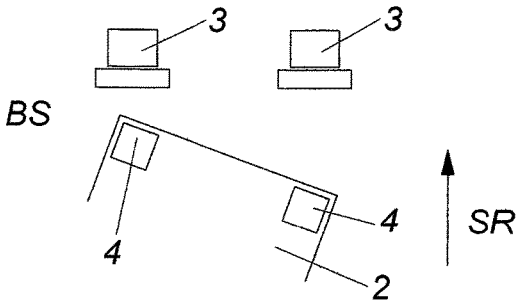
FIGS. 16 through 22 are diagrammatic views of an arrangement with locking devices, blocking devices and release means, FIGS. 23 through **28*b* are sectional views and 3D views of a first embodiment of a locking device according to the invention in different positions.
Figure 17:
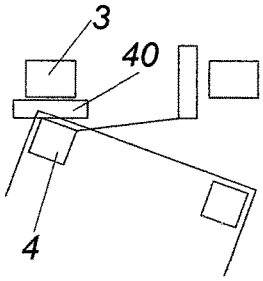

FIGS. 16 through 18 show in entirely diagrammatic and simplified form a fundamental variant of the present invention. In comparison, the diagrammatic views in FIGS. 19 through 22 show another variant.

Referring to FIG. 16, the drawer 2 which is in the inclined position is displaced with the control pin 4 in the closing direction SR relative to the sliding guide path 3.

If now as shown in FIG. 17 the left-hand control pin 4 passes almost to the locking portion of the sliding guide path 3, then the blocking device 40 blocks and prevents further movement of the control pin 4, and the control pin 4 can then not be locked in the sliding guide path 3. At the same time, however, the blocking device 40 on the right-hand side is already released.

As soon as now in FIG. 18 the right-hand side also follows on by being further pushed in, then—if the control pins 4 are at the same height—the left-hand blocking device 40 is also released and both control pins 4 can be locked in their respective sliding guide path 3. The diagrammatic lines shown in crossed configuration form the release device 45 which for example can be formed by sensors and electric signals.

Figure 19:
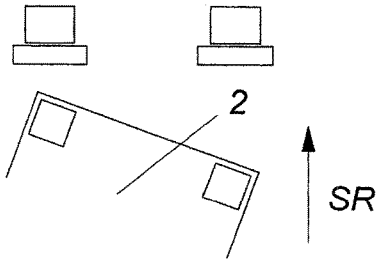

Referring to FIG. 19 the inclined drawer 2 is displaced as in FIG. 16 in the closing direction SR.

Figure 20:
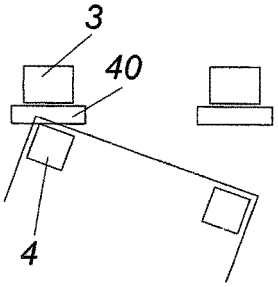

In FIG. 20 the left-hand control pin 4 (in specific terms the connecting element 23) comes into a condition of abutment with the end abutment 41 of the blocking device 40 whereby the control pin 4 cannot yet lock in the locking portion of the sliding guide path 3.

Figure 21:
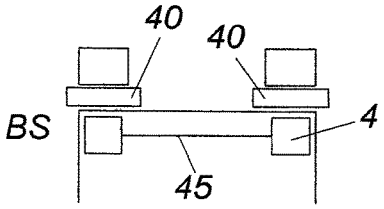
Figure 22:
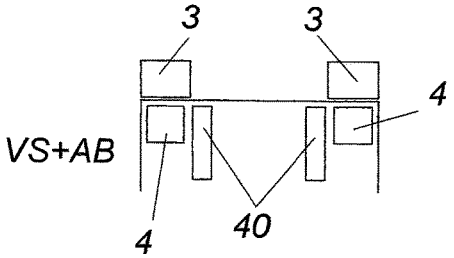

However, as shown in FIG. 21, as soon as the right-hand control pin 4 also reaches the same height, cancellation of the blocking position BS of the blocking device 40 is effected at the same time on both sides by way of the synchronization bar 46 of the release device 45 and the blocking device 40 moves into the cancelled blocking position AB. As a result, the arrangement can then reach the locking position VS shown in FIG. 22.

Figure 23:
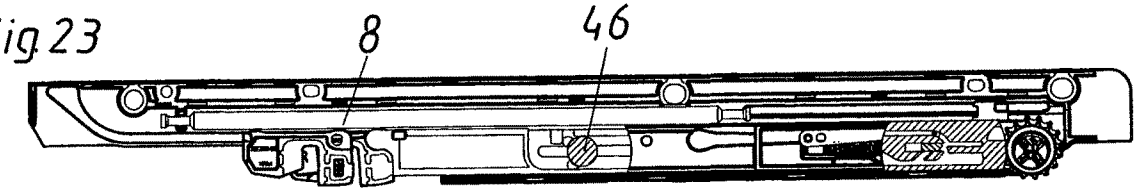
Figure 23A:
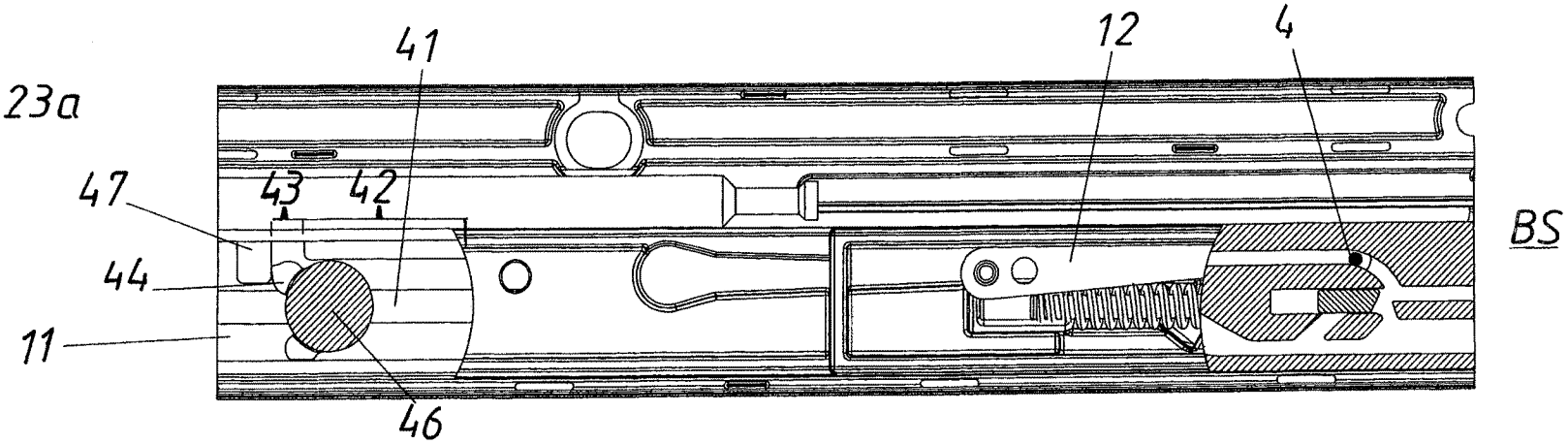
Figure 23B:
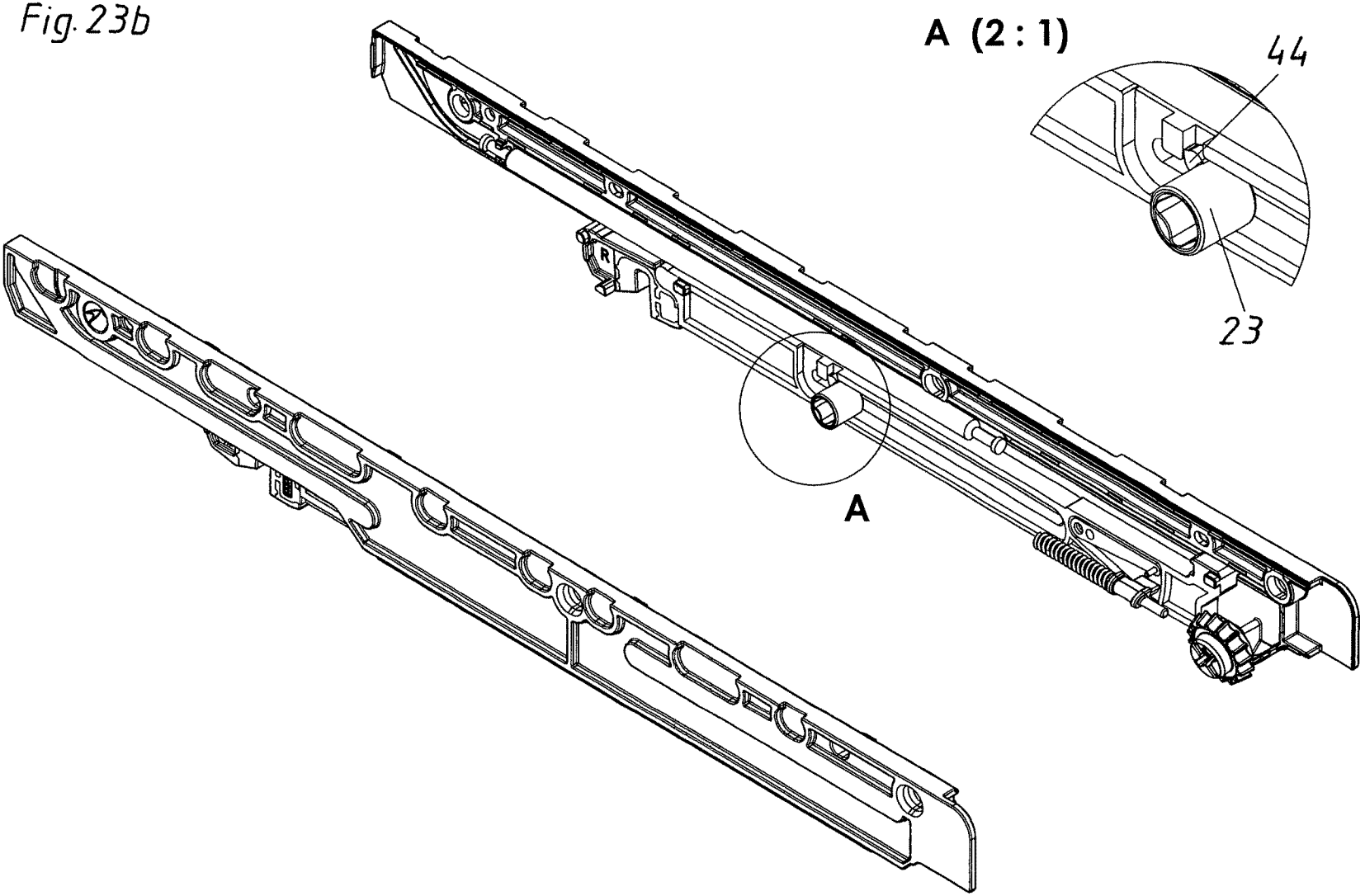

FIG. 23 is a partial view in section showing the right-hand side of an ejection device 1 with a locking device. It should be noted in that respect here that, for reasons of clarity, the description of this application always refers to the right-hand and the left-hand side, even though this always depends on the viewing location, in the case of a specific design configuration. The detail view of FIG. 23*a* and the 3D view of FIG. 23*b* also correspond to FIG. 23. In those three Figures, the connecting element 23 and its extensions 44 are already disposed almost at the end of the guide path 41 in the slider 11, wherein an extension 44 bears against the end abutment 47 of the guide path 41. In that respect, it can be seen in particular in FIG. 23*a* that the extension 44 is already disposed in the wide portion 43*b* of the guide path 41. As shown in FIGS. 23, 23*a* and 23*b* the blocking device 40 is still in the blocking position BS.

Figures 24, 24A:
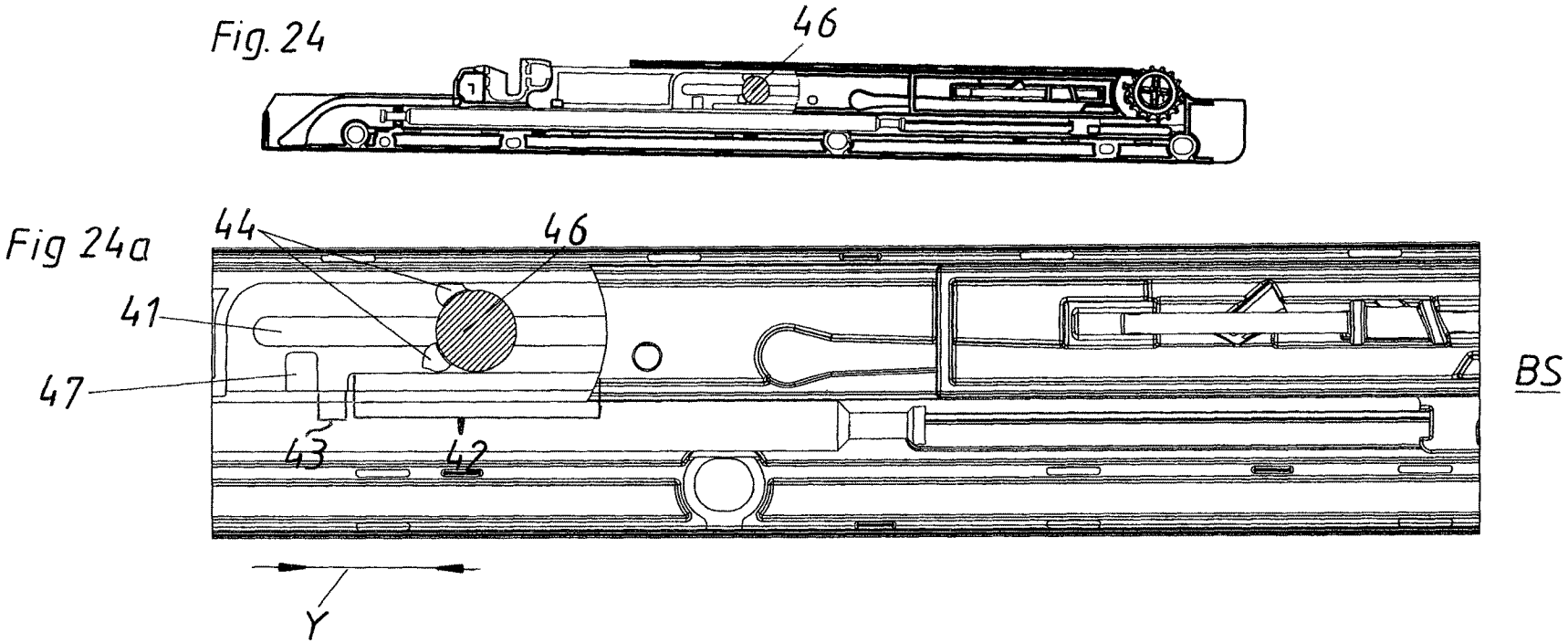
Figure 24B:
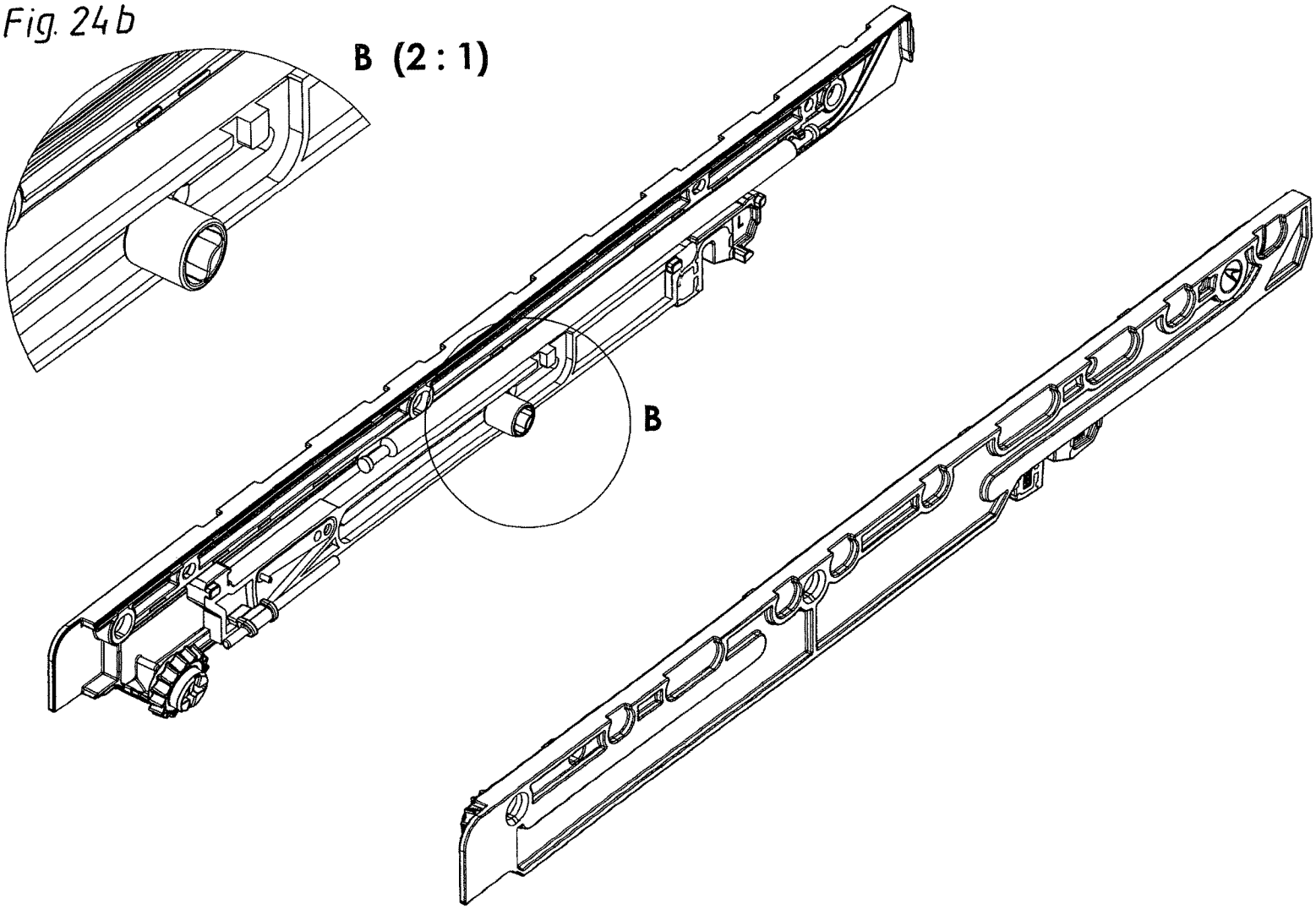

That is to be attributed to the fact that, on the left-hand side of the ejection device 1 (see FIGS. 24, 24*a* and 24*b*), the left-hand connecting element connected to the right-hand connecting element 23 by way of the synchronization bar 46 is still in the narrow portion 42 of the guide path 41. As the extensions 44 of the left-hand connecting element 23 bear at both sides against the surface of the guide path 41, there cannot be any rotation of the synchronization bar 46 together with the connecting elements 23. In the views in FIGS. 23 and 24, the moveable furniture part is in the inclined position, wherein the right-hand side is still remote from the locking position VS by the spacing X (see FIG. 25*a*), while the left-hand locking device is still remote from the locking position VS by the spacing Y (see FIG. 24*a*).

Figure 25:
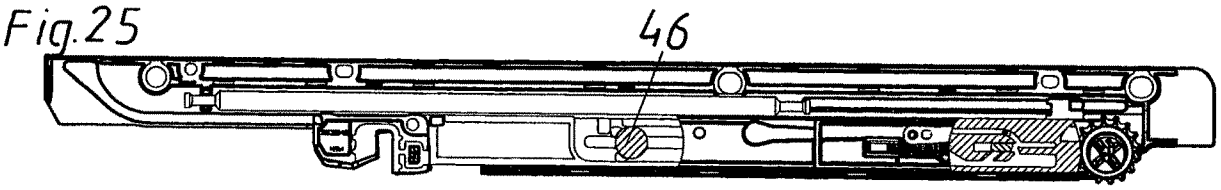
Figure 25A:
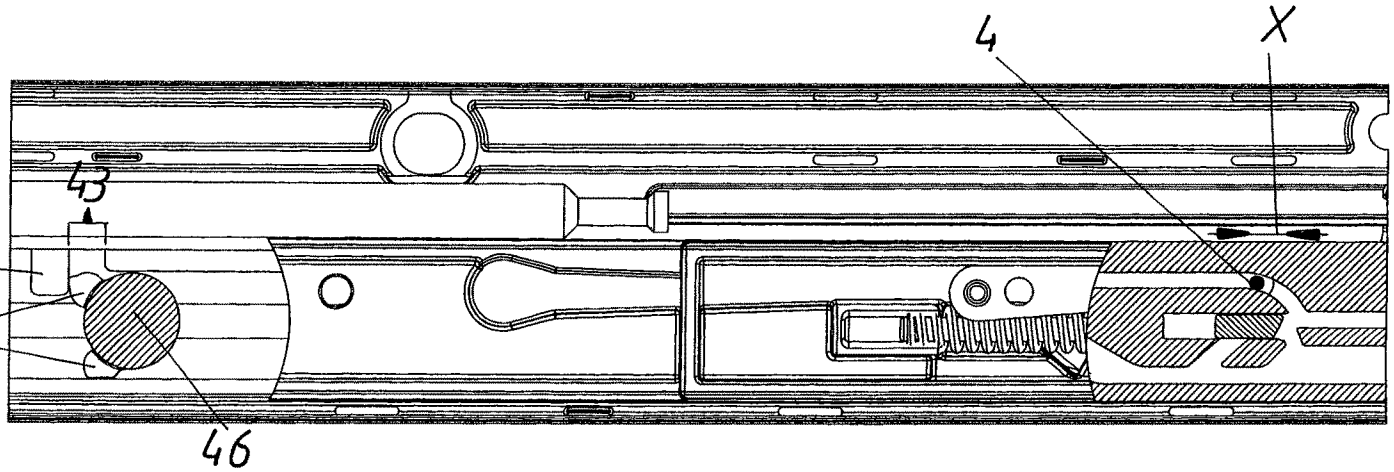
Figure 25B:
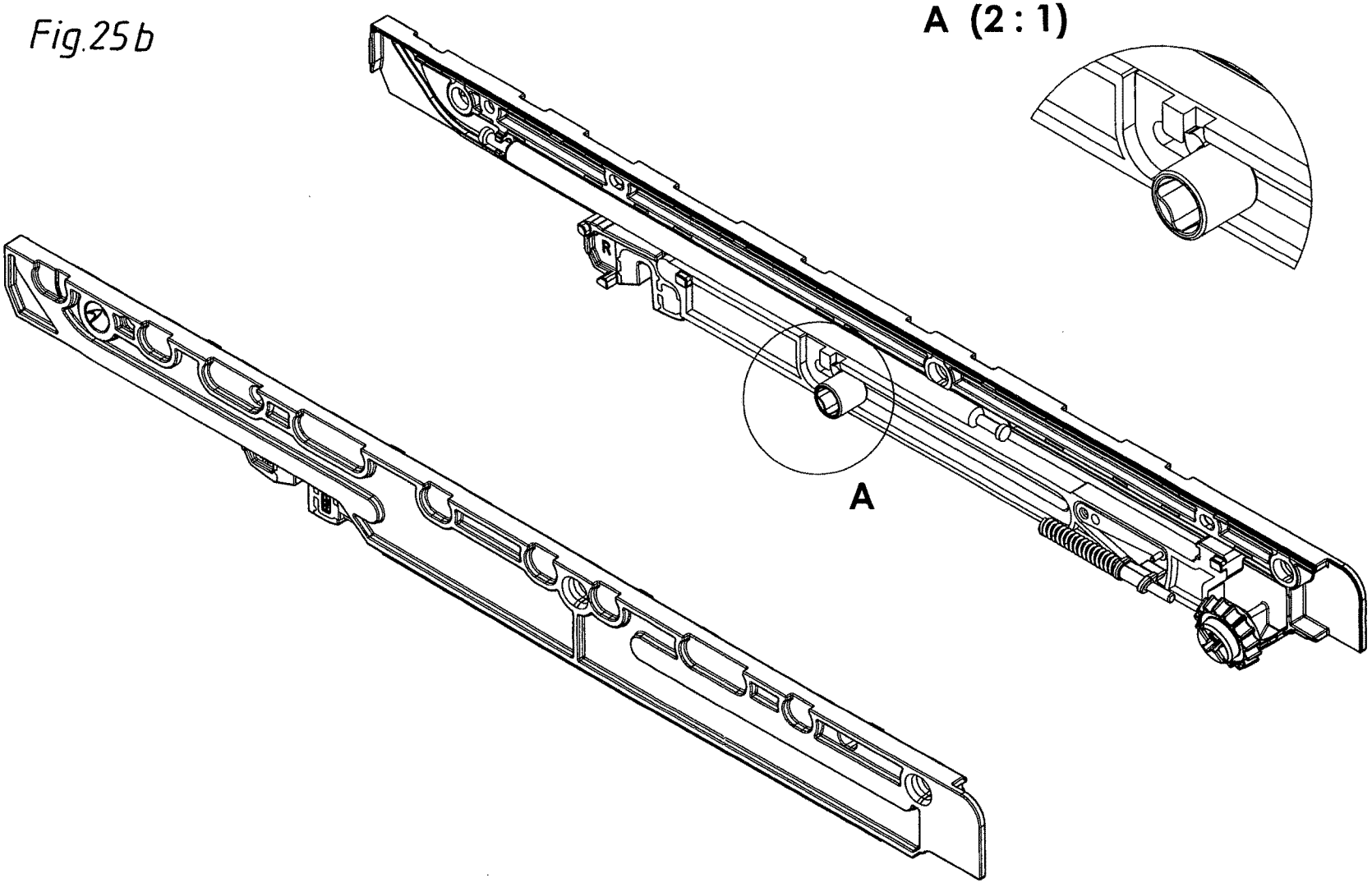
Figure 26:
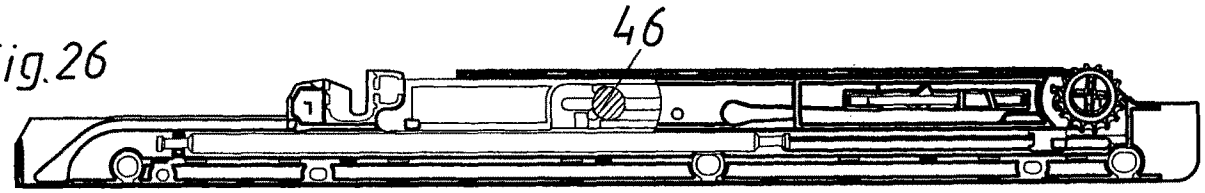
Figure 26A:
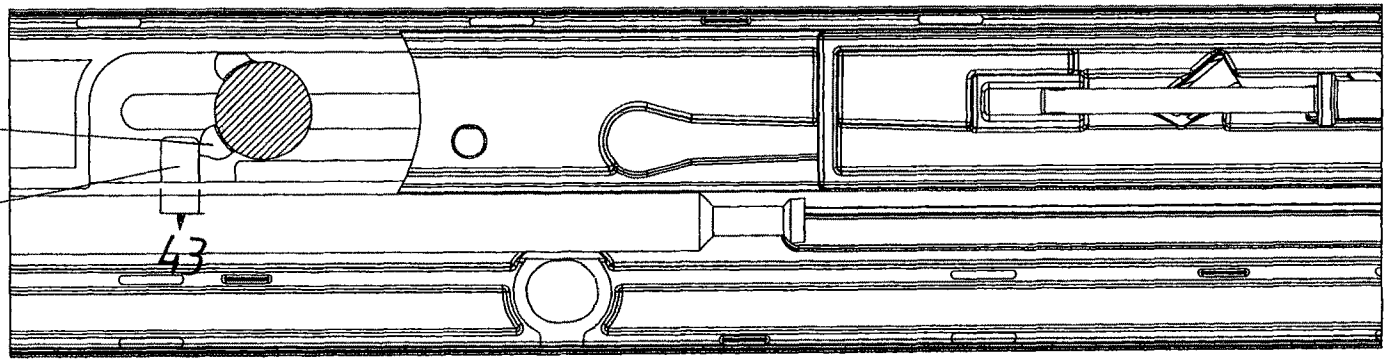
Figure 26B:
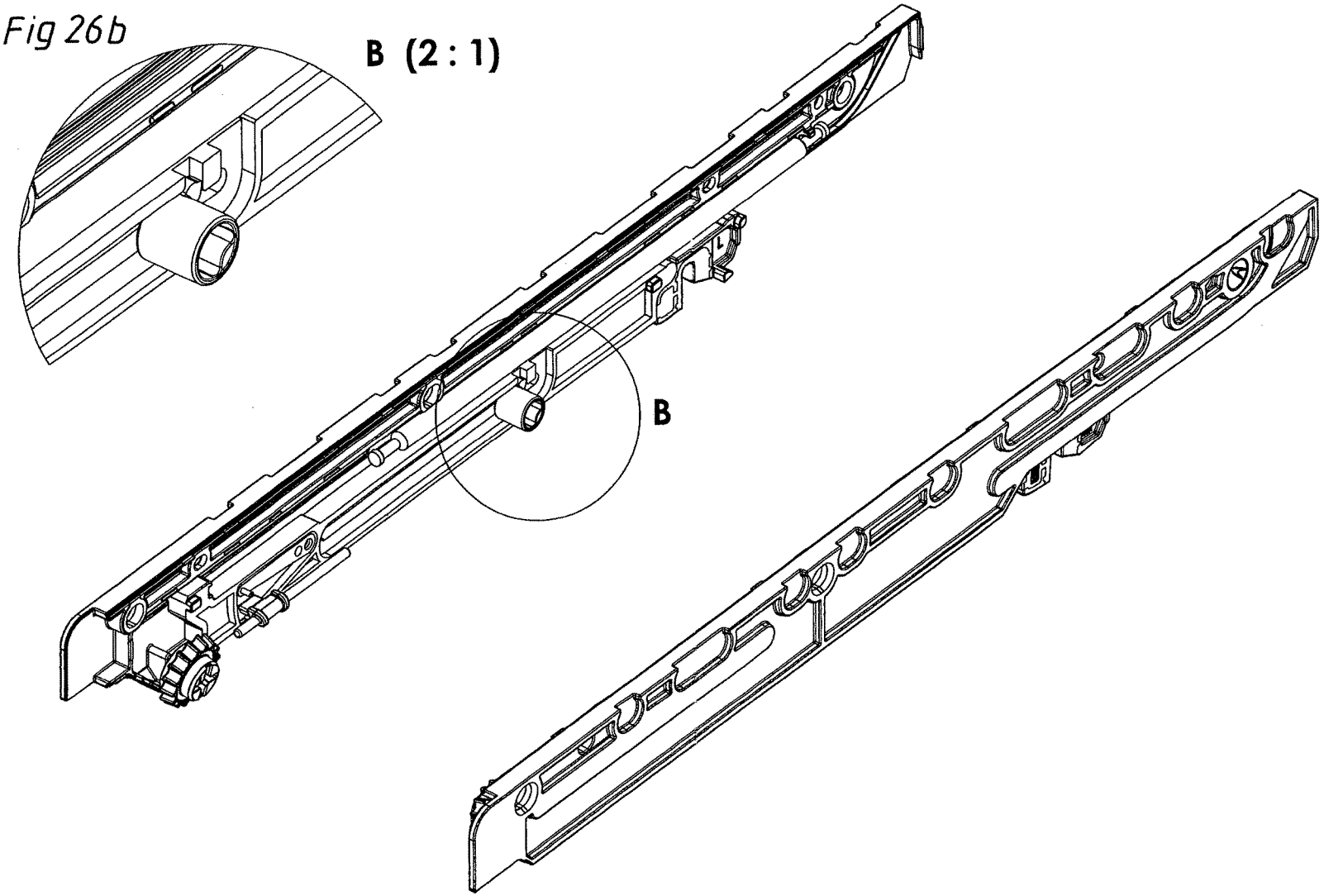
Figure 27:
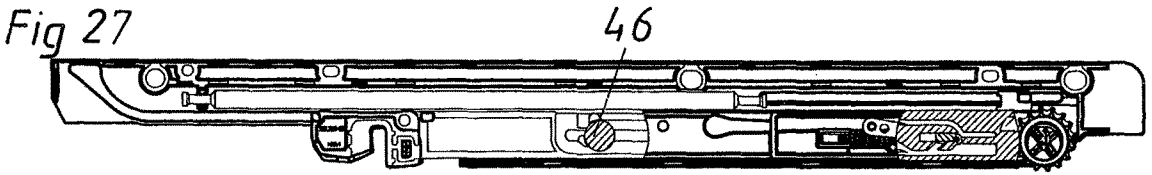
Figure 27A:
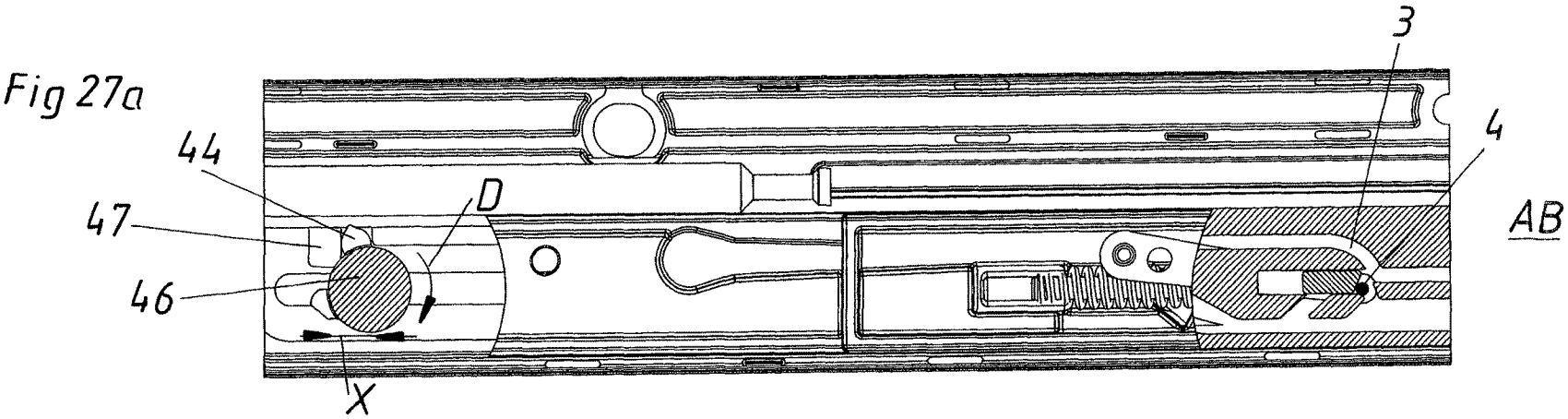
Figure 27B:
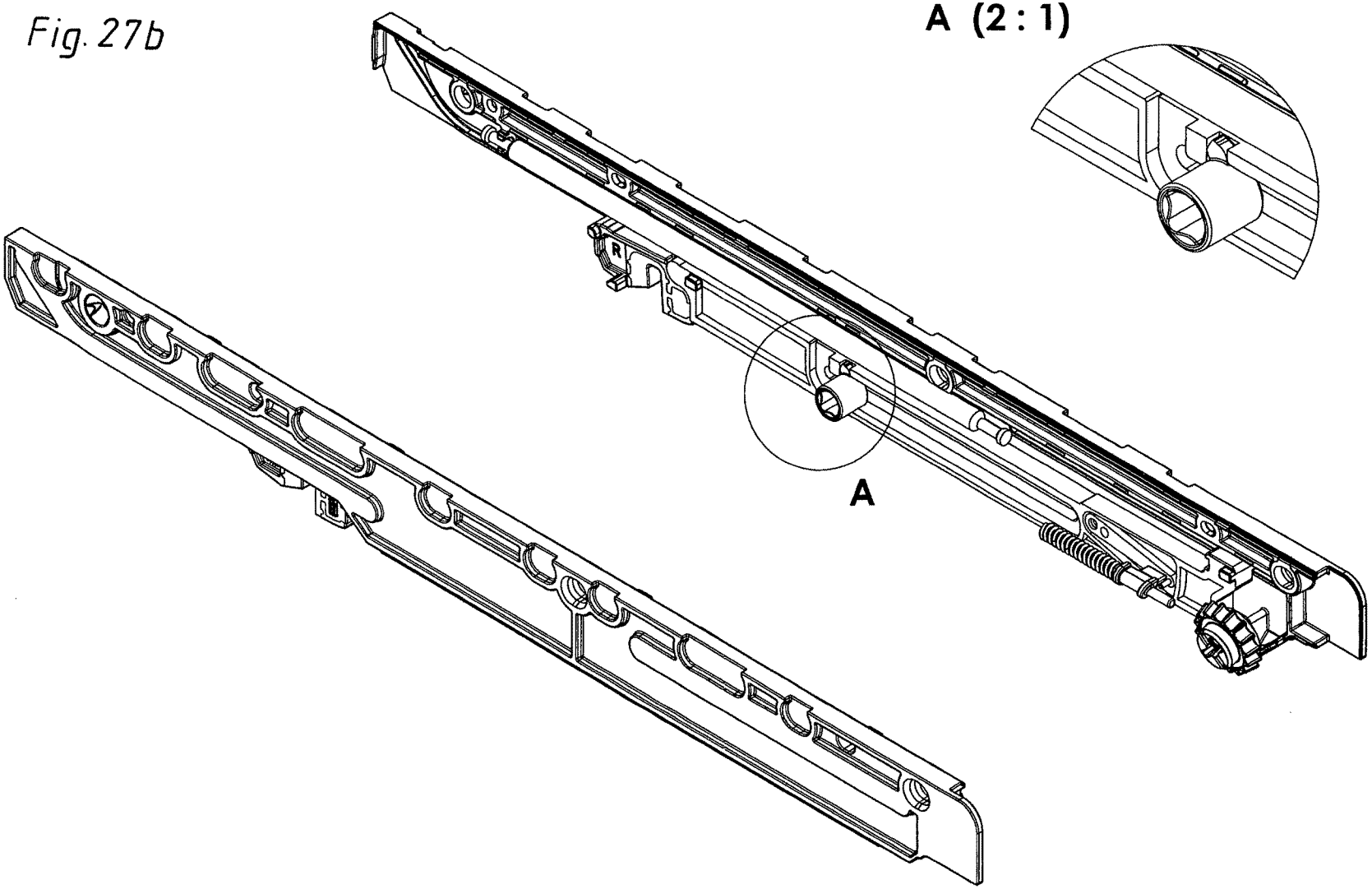
Figure 28:
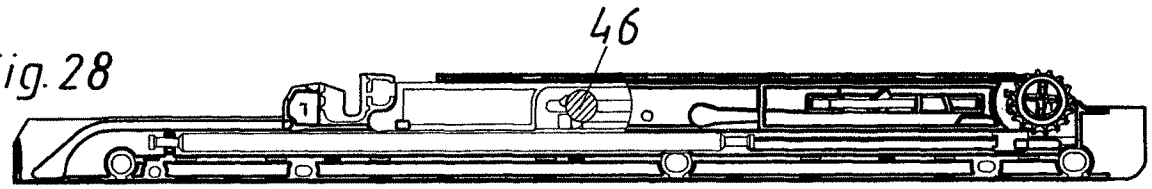
Figure 28A:
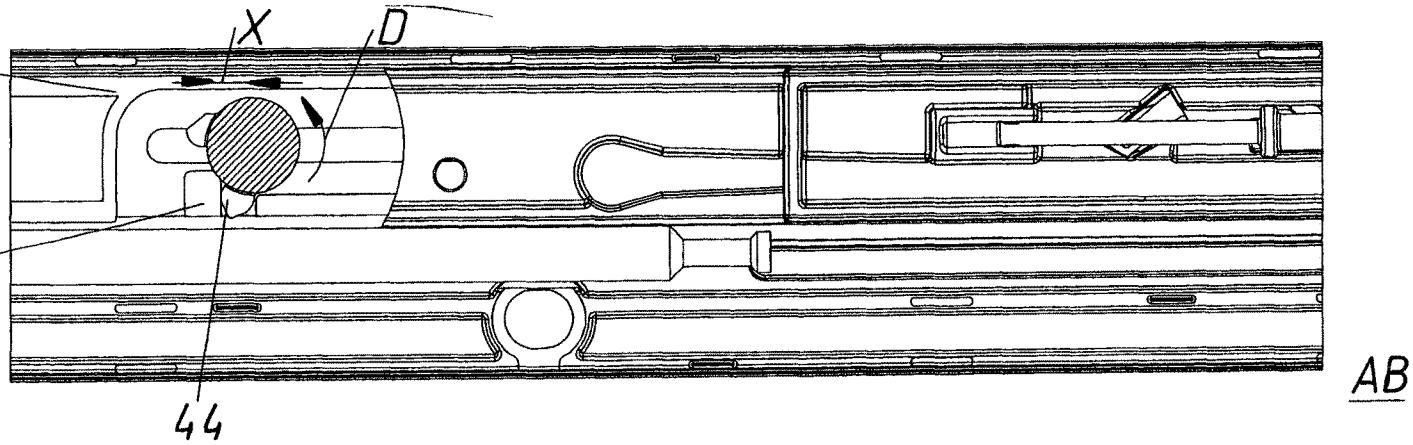
Figure 28B:
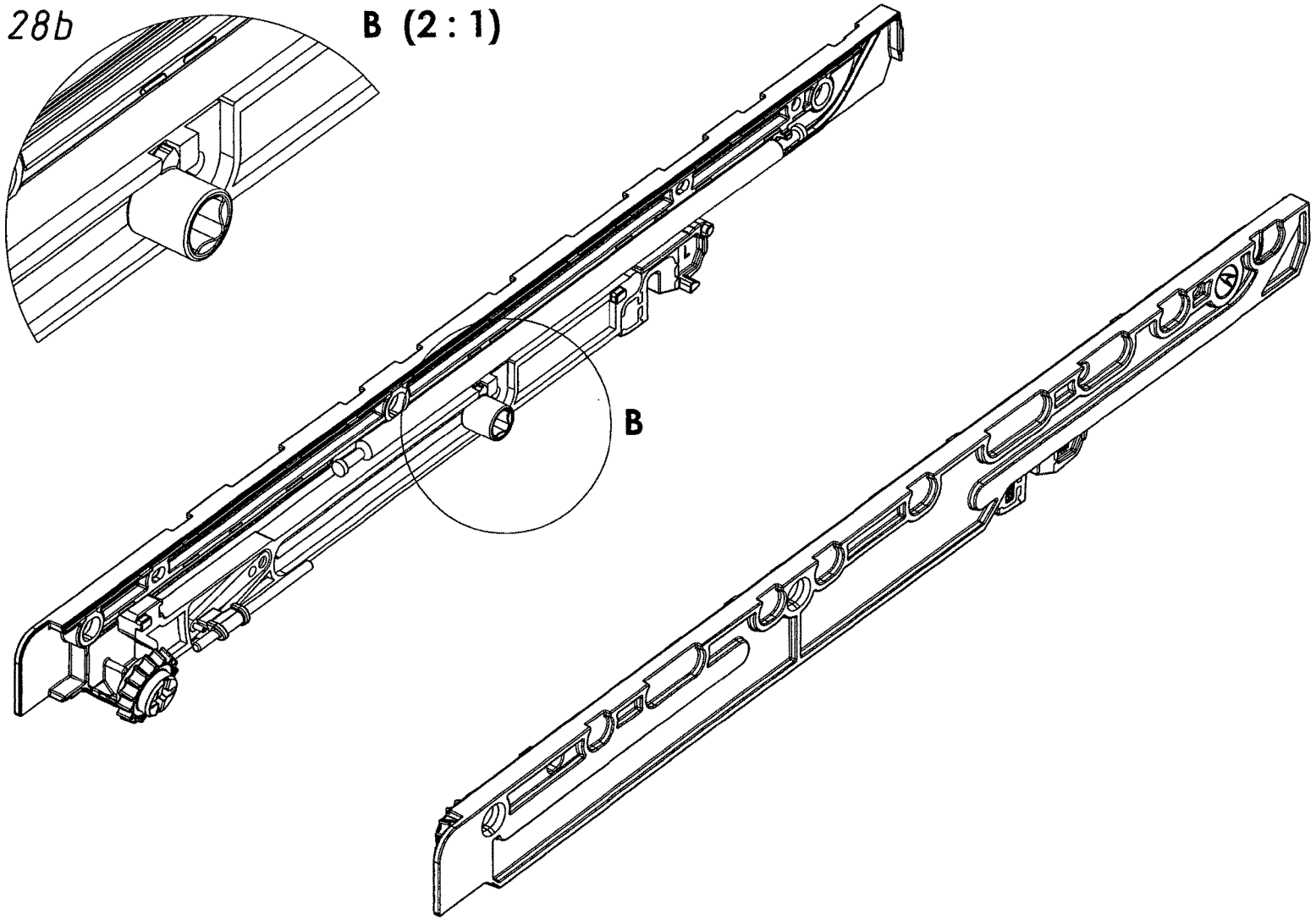

FIGS. 25, 25*a* and 25*b* correspond to FIGS. 23, 23*a* and 23*b*. In FIGS. 26, 26*a* and 26*b*, in comparison with FIGS. 24, 24*a* and 24*b*, the left-hand side of the locking device has moved further in the closing direction SR, whereby an extension 44 of the left-hand connecting element also bears against the end abutment 47. If now in that position the drawer is moved still further in the closing direction SR then the synchronization bar 46 begins to rotate by virtue of the extensions 44 sliding into the wide portion 43, and it passes into the position shown in FIGS. 27 and 28. By virtue of that approximately quarter turn in the direction of the arrow D, the blocking position BS is cancelled and the two sliders 11 can move by the distance X with respect to the connecting elements 23 together with the synchronization bar 46, whereby the control pin 4 is locked in the sliding guide path 3 (see FIG. 27*a*).

Thus, the embodiment shown in FIGS. 23 through 28 guarantees that the locking device locks at the same time on both sides and thus there cannot be any locking in respect of an inclinedly positioned drawer.

In comparison, in the embodiment shown in FIGS. 29 through 33, one-sided locking can very well occur.

Figure 29:
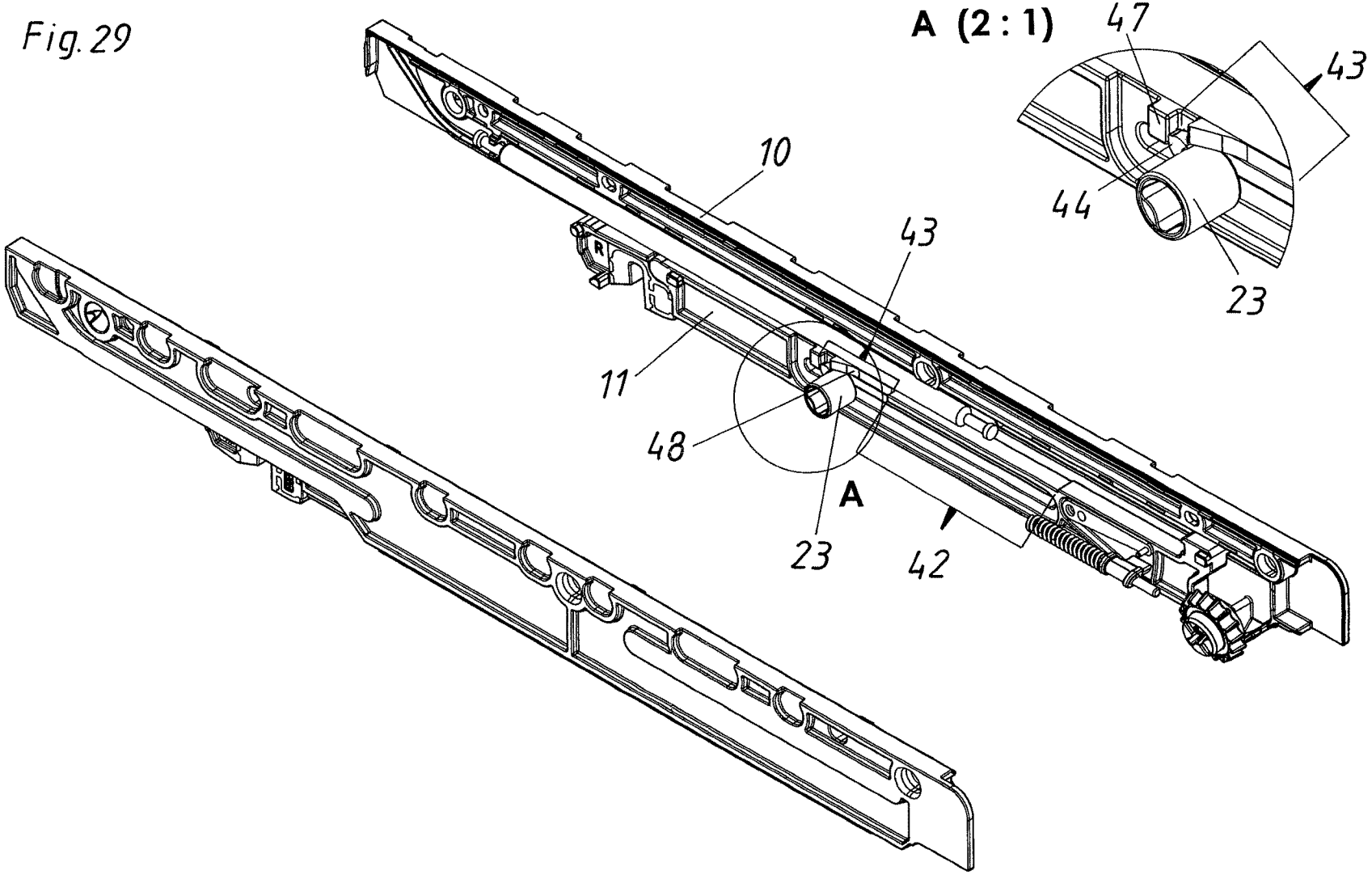
FIGS. 29 through 33** are 3D views of a second embodiment of a locking device according to the invention in different positions.
Figure 30:
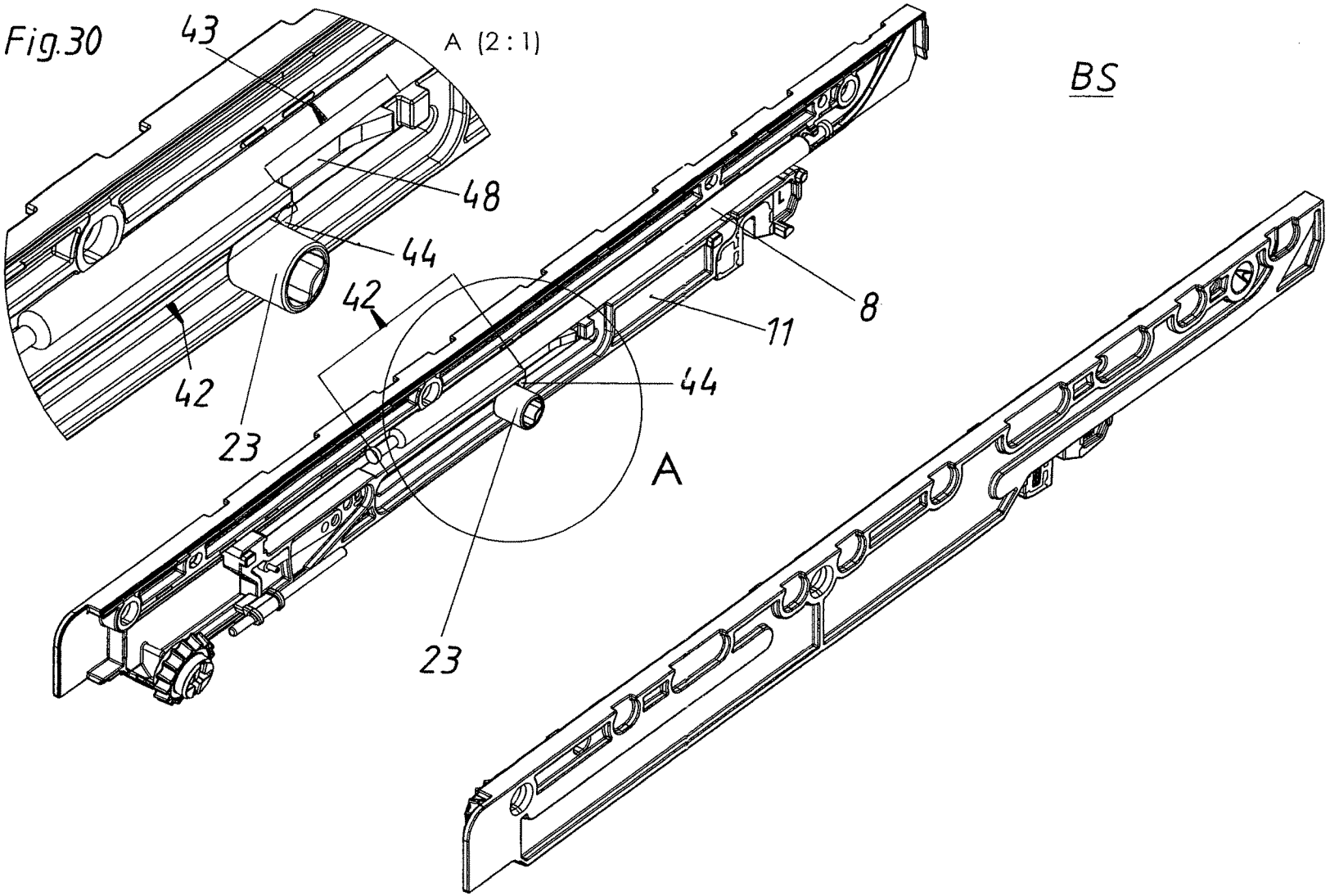

In that respect, FIG. 29 shows the right-hand side of a locking device in which an extension 44 of a connecting element 23 already bears against the end abutment 47 of the guide path 41. Thus the connecting element 23 is already in the region of the wide portion 43 of the guide path 41, in which basically rotation of the connecting element 23 together with the synchronization bar 46 would be possible. By virtue of the left-hand side of the locking device as shown in FIG. 30, however, that is prevented, whereby the connecting element 23 there together with the extension 44 is still in the narrow region 42 of the guide path 41 and thus the blocking device 40 is in the blocking position BS.

Figure 31:
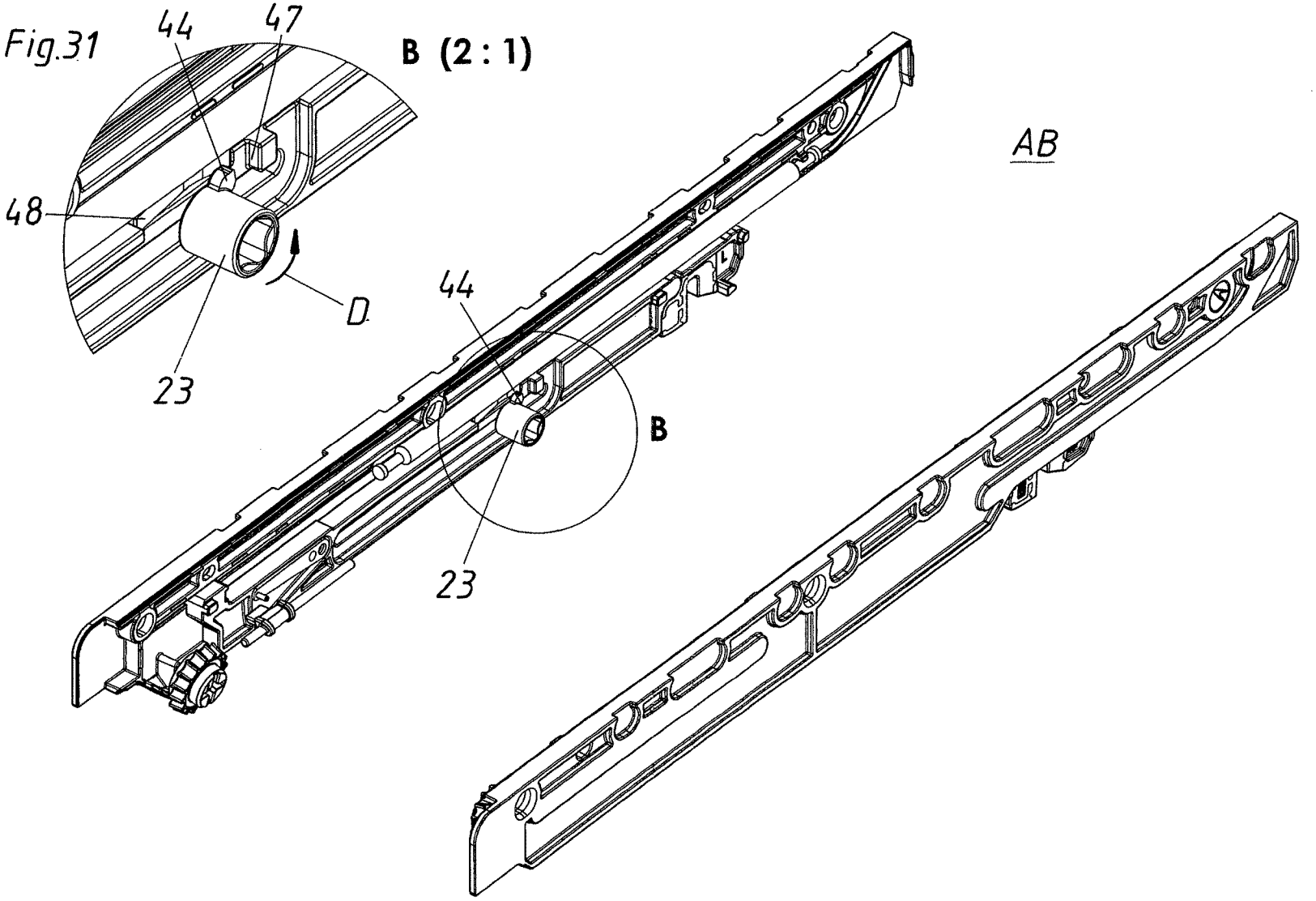
Figure 32:
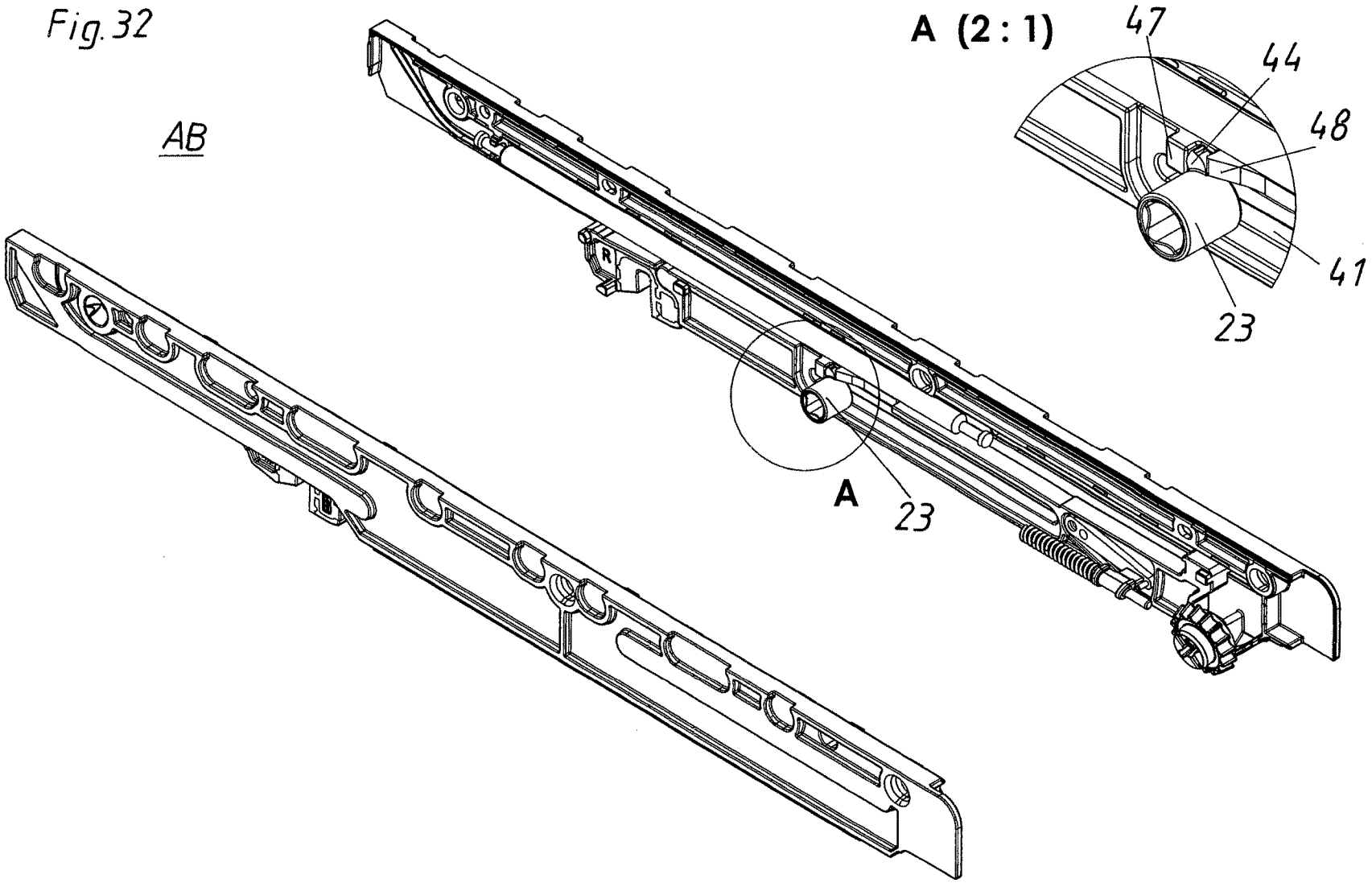
Figure 33:
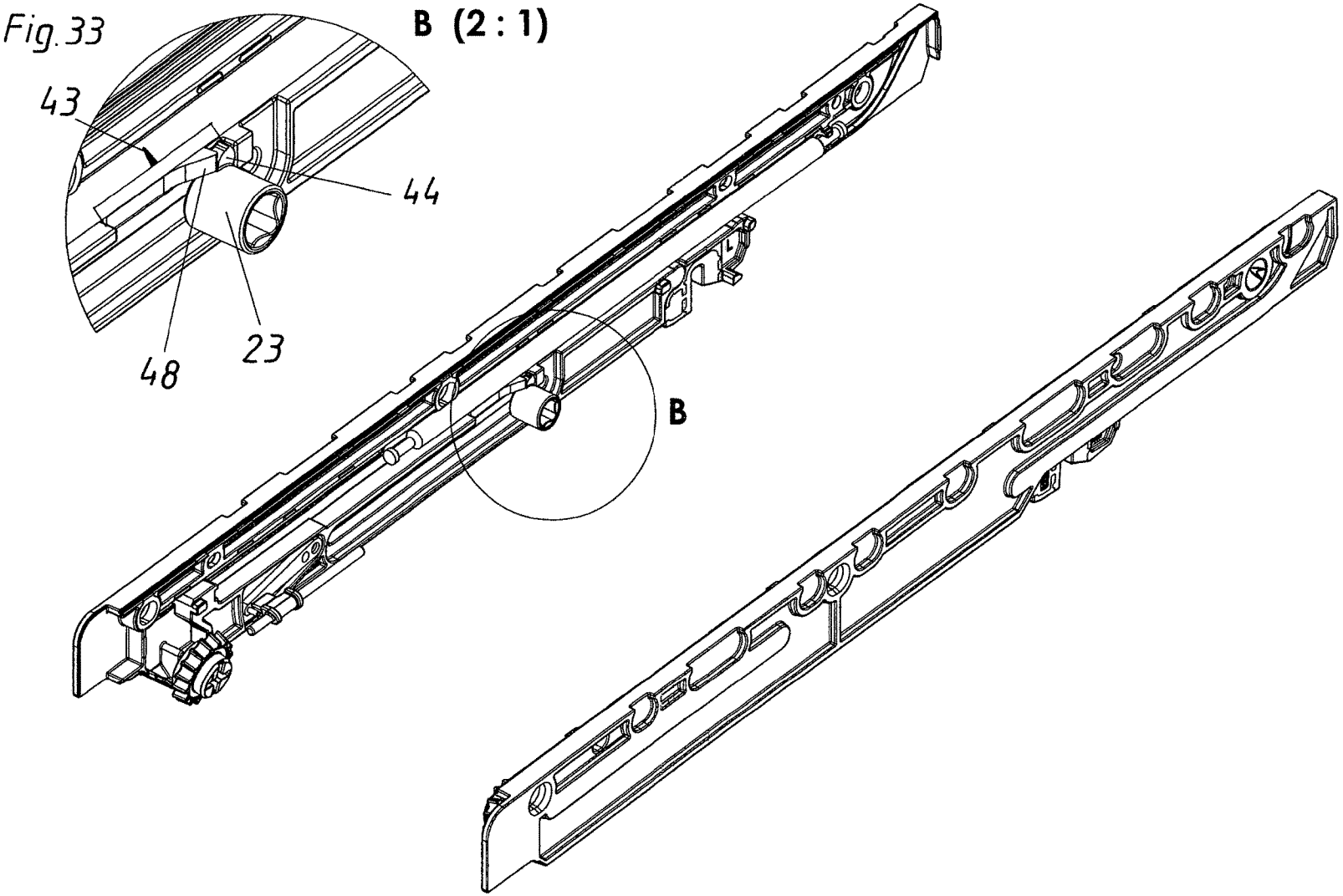

If now, however, the connecting element 23 is further displaced in the guide path 41 in the direction of the end abutment 47 by virtue of the left-hand side of the moveable furniture part 2 being further pushed in, the connecting element passes into the wide portion 43 of the guide path (see FIG. 31). As a result the synchronization bar 46 can rotate in the direction of the arrow D. The cancelled blocking position AB is thus reached and the right-hand locking device can move away from the end abutment 47 as shown in FIG. 32 or can escape into the wide portion 43 so that the locking position VS—in which the control pin 4 latches in the locking portion of the sliding guide path 3 (see for example also FIG. 27*a*)—is reached on the right-hand side. During that, however, the connecting element 23 is not yet entirely at the end of the guide path 41 in the left-hand locking device in FIG. 31 so that the left-hand locking device is not yet locked. If the moveable furniture part 2 has adopted such an inclined position as shown in FIGS. 31 and 32 in the state of the art it was not possible for the left-hand side to be further pushed in, by virtue of rotation of the synchronization teeth being no longer further possible. In the state of the art, therefore, the inclined positioning has to be tolerated. The advantage of the present invention, however, is now that the locking position VS can nonetheless be reached from that inclined position on the left-hand side as shown in FIG. 31, by being further pushed in. Starting from FIG. 31 the connecting element 23 is moved in direction of the end abutment 47 by a further closing movement and in so doing urges the elastically bending holding element 48 which is in the form of a rocking arm rearwardly (out of the guide path 41) and finally attains the position shown in FIG. 33 in which the extension 44 is held between the holding element 48 which is moving forwardly again, and the end abutment 47. The locking position VS is also reached on the left-hand side in that condition, without damage occurring.

Thus, the present invention provides an arrangement with locking devices disposed at both sides of a moveable furniture part, in which damage-free locking is guaranteed on both sides of the drawer—in spite of the drawer being pushed in inclinedly.

In general it should be pointed out that the synchronization bar 46 is only shown in one view. Naturally such a synchronization bar 46 can also be mounted as is known per se between the connecting elements 23 and is not shown in the other Figures only for reasons of drawing clarity. In the installed condition, the synchronization bar 46 is connected to the connecting elements 23 in positively locking and non-rotational relationship. The synchronization bar 46 can be made from aluminum in an extrusion process. The geometrical configuration of the extensions 44 projecting from the connecting element 23 can be any desired configuration. It is only necessary to guarantee that a rotary movement of the connecting elements 23 together with synchronization bar 46 is allowed only in a last portion of the closing travel (corresponds to the length of the wide portion 43).

The invention claimed is:

1. An arrangement comprising:

a synchronization bar having a pair of connecting elements each located on a respective end of said synchronization bar; and two locking devices configured to be arranged on opposing sides of a moveable furniture part for locking the moveable furniture part in a locking position with respect to a furniture carcass, each of said two locking devices including:

a blocking device configured to be movable into a blocking position to prevent the moveable furniture part from being placed into the locking position, and said blocking device configured to be in the blocking position during a closing movement of the moveable furniture part, said blocking device including a guide path for guiding travel of a respective one of said connecting elements of said synchronization bar, said guide path being configured to block further travel of said respective one of said connecting elements through said guide path in a closing direction to prevent the moveable furniture part from moving past a blocked position in the closing direction and being placed into the locking position if said synchronization bar is oriented at an angle during the closing movement of the moveable furniture part; and a release device configured to cancel the blocking position of said blocking device associated with one of said two locking devices located at the opposing side of the moveable furniture part from said respective release device to thereby allow the moveable furniture part to move past the blocked position in the closing direction and into the locking position.

2. The arrangement as set forth in claim 1, wherein each release device is configured to cancel only the blocking position of said blocking device associated with said one of said two locking devices located at the opposing side of the moveable furniture part from said respective release device.

3. The arrangement of claim 1, wherein each of said connecting elements includes a radially-projecting extension, and said guide path has an end abutment arranged to contact said radially-projecting extension if said synchronization bar is oriented at an angle during the closing movement of the moveable furniture part so as to prevent the moveable furniture part from moving past the blocked position in the closing direction.

4. The arrangement as set forth in claim 1, wherein said synchronization bar connects said release device of a first one of said two locking devices with said release device of a second one of said two locking devices, and said respective release devices of said two locking devices are configured to simultaneously cancel the blocking position of said blocking device of said first one of said two locking devices and the blocking position of said blocking device of said second one of said two locking devices.

5. The arrangement as set forth in claim 4, wherein said blocking device of each of said two locking devices is configured to prevent rotation of said synchronization bar when in the blocking position.

6. The arrangement as set forth in claim 4, further comprising a housing, wherein each of said two locking devices has a respective slider displaceable with respect to said housing between a locking position and an open position;

wherein each of said two sliders has said guide path in which said respective one of said connecting elements is displaceable to an end abutment, said respective one of said connecting elements having radially-projecting extensions bearing against an inner surface wall of said respective guide path, and said respective one of said connecting elements is configured to be rotatably guided based on a position of said radially-projecting extensions, said connecting elements are coupled in a synchronized movement relationship by said synchronization bar;

wherein said respective blocking device of each of said two locking devices is formed of:

an end abutment of said guide path of at least one of said two sliders;

a narrow portion of said guide path of at least one of said two sliders; and at least one radially-projecting extension of at least one of said connecting elements;

wherein said respective release device of each of said two locking devices is formed of:

a wide portion of said guide path of both of said two sliders;

said synchronization bar having said connecting elements associated with said two sliders;

wherein said blocking device is configured such that, in the blocking position, said at least one radially-projecting extension of said of at least one of said connecting elements bears against said narrow portion to prevent rotary movement of said synchronization bar; and wherein said release device is configured such that, in the cancelled blocking position, radially-projecting extensions of said respective one of said connecting elements associated with said two sliders are arranged in the wide portion of said respective guide path so that said connecting elements are rotatable together with said synchronization bar.

7. The arrangement as set forth in claim 6, wherein each of said two locking devices further includes a control lever, a sliding guide path, and a control pin, said respective slider is lockable in the locking position in said respective sliding guide path provided in said housing by said respective control pin arranged on said respective control lever.

8. The arrangement as set forth in claim 6, wherein said blocking device is configured such that, in the blocking position, said at least one radially-projecting extension of said of at least one of said connecting elements limits displacement travel of the slider by bearing against said end abutment of said respective guide path to prevent locking of said respective one of said two sliders in the locking position; and wherein said release device is configured such that, in the cancelled blocking position, said at least one radially-projecting extension of said of at least one of said connecting elements is moveable away from said end abutment of said respective guide path to allow displacement travel of said respective one of said two sliders and allow locking of said respective one of said two sliders is in the locking position.

9. The arrangement as set forth in claim 8, wherein said release device is configured such that, in the cancelled blocking position, said at least one radially-projecting extension of said of at least one of said connecting elements is rotatable away from said end abutment of said respective guide path.

10. The arrangement as set forth in claim 8, wherein said release device is configured such that, in the cancelled blocking position and with a first one of said two sliders locked in the locking position, a second one of said two sliders associated with the other of said two locking devices is moveable into the locking position.

11. The arrangement as set forth in claim 8, wherein said release device is configured such that, in the cancelled blocking position, radially-projecting extensions of both connecting elements are moveable away from said end abutment of said respective guide path to allow displacement travel of both of said two sliders and allow synchronous locking of said two sliders is in the locking position.

12. The arrangement as set forth in claim 11, wherein said release device is configured such that, in the cancelled blocking position, radially-projecting extensions of both connecting elements are rotatable away from said end abutment of said respective guide path.

13. An article of furniture comprising:

a furniture carcass;

a moveable furniture part moveable relative to said furniture carcass; and a lockable ejection device for moving and locking said moveable furniture part relative to said furniture carcass, said lockable ejection device including said arrangement as set forth in claim 1.

14. The article of furniture as set forth in claim 13, wherein said moveable furniture part is a drawer.

15. The article of furniture as set forth in claim 13, wherein said moveable furniture part is mounted displaceably to the furniture carcass by an extension rail including a drawer rail connected to said moveable furniture part, and a carcass rail connected to said furniture carcass, said lockable ejection device being arranged at one of said drawer rail or said moveable furniture part, and said lockable ejection element being connected in a closed position of said moveable furniture part to an entrainment member on one of said furniture carcass or said carcass rail.

16. The article of furniture as set forth in claim 15, wherein said extension rail further includes a central rail between said drawer rail and said carcass rail.

17. The article of furniture as set forth in claim 15, wherein said lockable ejection element is connected in the closed position of said moveable furniture part to said entrainment member in a positively locking relationship.

* * * * *